US006112472A

United States Patent [19]

Van Dyk et al.

[11] Patent Number: 6,112,472

[45] Date of Patent: Sep. 5, 2000

[54] INTEGRATED FURNITURE SYSTEM INCLUDING OVERHEAD FRAMEWORK SYSTEM AND PARTITION SYSTEM

[75] Inventors: Daniel R. Van Dyk, Belding; Martin L. Bolinger, Kentwood; Brad L. Dykstra, Jenison; Jason T. Otto, Wyoming; Michael Miles, Grand Rapids, all of Mich.

[73] Assignee: Steelcase Development Inc., Grand Rapids, Mich.

[21] Appl. No.: 09/153,216

[22] Filed: Sep. 14, 1998

[51] Int. Cl.[7] ..... A47B 83/00

[52] U.S. Cl. ..... 52/36.1; 52/220.7; 52/239; 52/243.1

[58] Field of Search ..... 52/36.1, 220.7, 52/239, 243.1, 745.13

[56] References Cited

U.S. PATENT DOCUMENTS

| | | | |
|---|---|---|---|
| 3,195,698 | 7/1965 | Codrea . | |
| 3,398,981 | 8/1968 | Vincens . | |
| 3,425,568 | 2/1969 | Albright . | |
| 3,514,883 | 6/1970 | Albright . | |
| 4,048,059 | 9/1977 | Evans . | |
| 4,316,676 | 2/1982 | Turner . | |
| 4,408,928 | 10/1983 | Steinke . | |
| 4,567,698 | 2/1986 | Morrison . | |
| 4,606,394 | 8/1986 | Bannister | 52/239 X |
| 4,619,486 | 10/1986 | Hannah et al. . | |
| 4,625,483 | 12/1986 | Zacky et al. . | |
| 4,883,330 | 11/1989 | Armstrong et al. . | |
| 4,993,205 | 2/1991 | Dull et al. . | |
| 5,003,740 | 4/1991 | Dull et al. . | |
| 5,024,030 | 6/1991 | Morrison . | |
| 5,134,826 | 8/1992 | La Roche et al. . | |
| 5,187,908 | 2/1993 | Losensky . | |
| 5,220,871 | 6/1993 | Grund et al. . | |
| 5,362,923 | 11/1994 | Newhouse et al. | 52/239 X |
| 5,363,612 | 11/1994 | Erickson . | |
| 5,377,466 | 1/1995 | Insalaco et al. . | |
| 5,394,658 | 3/1995 | Schreiner et al. . | |
| 5,511,348 | 4/1996 | Cornell et al. . | |
| 5,600,926 | 2/1997 | Ehrlich . | |
| 5,606,836 | 3/1997 | Insalaco et al. . | |

(List continued on next page.)

OTHER PUBLICATIONS

Exhibit A is a brochure entitled *Knoll—Hannah Desk System,* 18 pages, dated Oct. 1986.

(List continued on next page.)

*Primary Examiner*—Carl D. Friedman
*Assistant Examiner*—Kevin D. Wilkens
*Attorney, Agent, or Firm*—Price Heneveld Cooper Dewitt & Litton

[57] ABSTRACT

An integrated furniture system for subdividing a building space includes an overhead framework system and a furniture-supporting partition system integrated to be used together, separately, or in a partially overlapping arrangement. The overhead framework system is constructed to provide a relatively open meeting area, and includes at least one horizontally extending beam and posts supporting the beam overhead. The beam and posts are interconnected to form a space below the beam and between the posts, with the space having known height and width dimensions. The furniture-supporting partition system is constructed to subdivide the building space into an arrangement of physically separated offices. The furniture-supporting partition system includes side surfaces defining second width and height dimensions. The partition includes at least a portion positioned in the space under the beam and is potentially positioned completely under the beam in the space. The partition may or may not completely fill the space. The partition is connected to the post and beam by slip-fit connectors at its top and sides, respectively, with the slip-fit connection permitting vertical adjustment of the partition without also having to vertically adjust the beam. The partition is self-supporting, and includes levelers for separate vertical adjustment on the floor surface of the building space, although the connectors stabilize the partition from tipping over.

22 Claims, 23 Drawing Sheets

U.S. PATENT DOCUMENTS

| | | | |
|---|---|---|---|
| 5,685,113 | 11/1997 | Reuter et al. . | |
| 5,694,729 | 12/1997 | Blackburn et al. . | |
| 5,746,034 | 5/1998 | Luchetti et al. . | |
| 5,746,035 | 5/1998 | Seiber et al. . | |
| 5,816,000 | 10/1998 | Izatt et al. | 52/239 X |
| 5,899,025 | 5/1999 | Casey et al. | 52/36.1 |
| 5,974,742 | 11/1999 | Schreiner et al. . | |

OTHER PUBLICATIONS

Exhibit B is a brochure entitled *Knoll—Hannah Desk System,* 13 pages, undated but published in 1986.

Exhibit C is a publication entitled *Knoll—Hannah Desk System—Electrical Assembly Guide,* (12 pages), undated but published in 1986.

Exhibit D is a publication entitled *Knoll—Hannah Desk System—Assembly Guide,* 12 pages, undated but published in 1986.

Exhibit A is a brcchure entitled *Bosse, Man Space Office environment,* 20 pages, date unknown, but at least as early as Dec. 30, 1994.

Exhibit B is a brochure entitled *Bosse Man Space,* 10 pages, date unknown, but at least as early as Dec. 30, 1994.

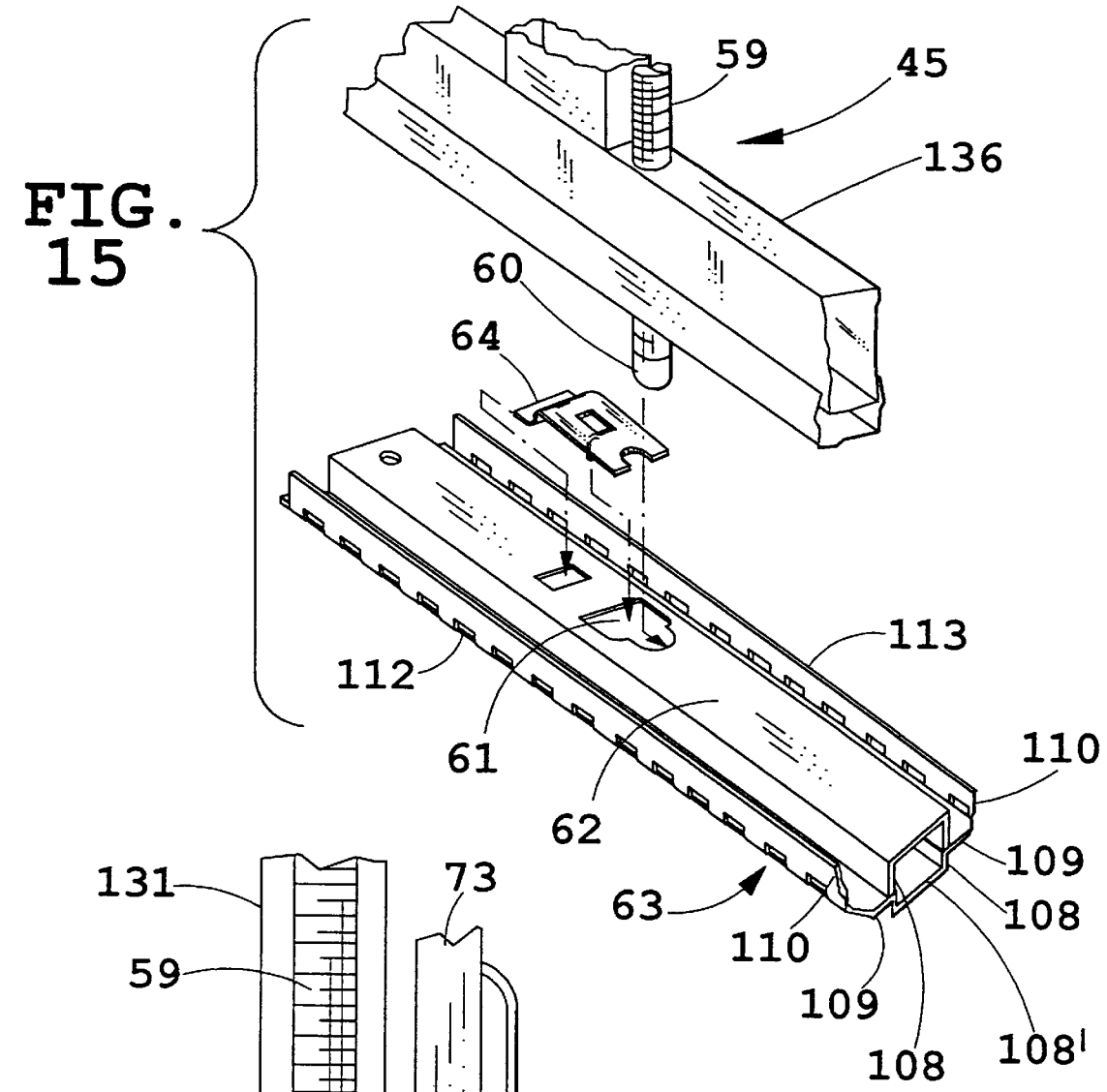
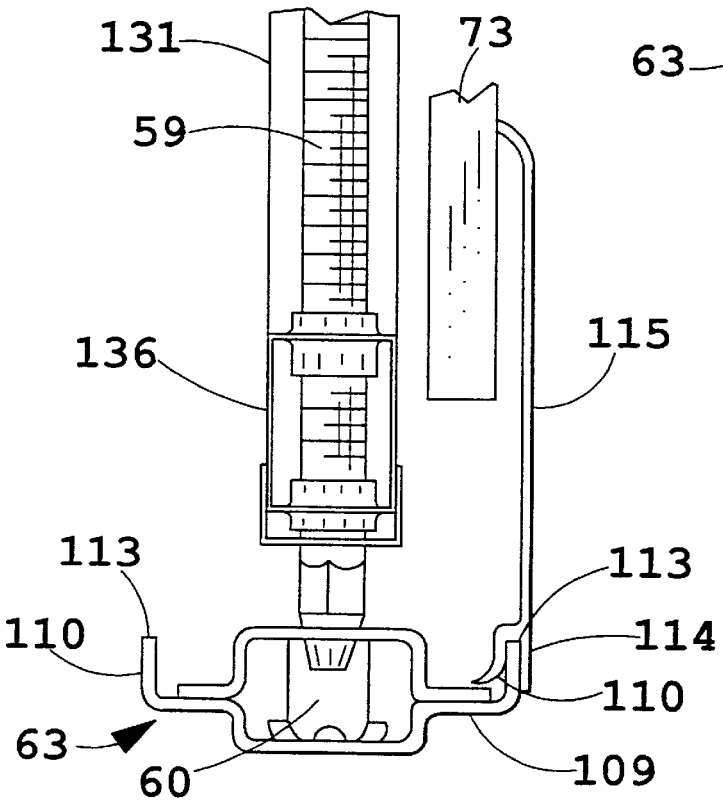
FIG. 16

INTEGRATED FURNITURE SYSTEM INCLUDING OVERHEAD FRAMEWORK SYSTEM AND PARTITION SYSTEM

CROSS REFERENCE TO RELATED APPLICATIONS

The present application is related to the following copending, coassigned, related U.S. patents and patent applications, which patents and applications are incorporated herein in their entirety:

| APPLICATION SER NO. | U.S. PAT. NO. | FILING DATE | TITLE |
|---|---|---|---|
| 08/367,802 | 5,746,034 | 12/30/94 | PORTABLE PARTITION SYSTEM |
| 08/367,804 | 5,784,843 | 12/30/94 | INTEGRATED PREFABRICATED FINISH SYSTEM FOR BUILDING SPACE |
| 08/579,614 | 5,746,035 | 12/26/95 | PARTITION SYSTEM |
| 08/687,724 | 5,816,001 | 07/26/96 | PARTITION CONSTRUCTION INCLUDING INTERCONNECTION SYSTEM AND REMOVABLE COVERS |
| 08/686,701 | 5,836,121 | 07/26/96 | CONNECTION SYSTEM FOR CONNECTING PARTITION AND FLOOR CHANNEL |
| 08/970,251 | 5,943,834 | 11/13/97 | PARTITION CONSTRUCTION |

BACKGROUND OF THE INVENTION

The present invention concerns furniture systems for subdividing a building space, and more particularly concerns an integrated furniture system including two separate space-furnishing systems that can be used alone or together for optimal subdivision and outfitting of a building space.

Partition systems are well-known in the art for subdividing building space into physically separated work areas and/or office areas. The partition systems are typically constructed to support individual office-type work activities, and are often adapted for specialized functions, such as carrying utilities, supporting furniture and accessories, providing visual comfort and aesthetics, sound absorption, and the like. Physical separation, privacy, aesthetics, and features supporting particular work tasks are typically very important to these systems.

Overhead framework systems are known that are adapted to support activities in open areas, such as for meeting areas and common areas. Many of these include an overhead framework of beams that are supported by posts. The openness of these systems is particularly conducive to group activities, where conversation and interaction is very important. Many of these systems include accessories and adaptations to support and encourage specialized activities, such as erasable boards that can be written on, screens, furniture, and the like.

Partition systems are also known for subdividing a building space into individual office areas. Some of these partitions are constructed to be rearrangeable.

Some businesses have installed both a partition system and an overhead frame system in adjacent areas. However, the interface of these two different systems can be problematic, since the two systems are so different and have such different design criteria. Specifically, existing ones of these two different systems often do not look like they go together, but instead provide very different visual effects, such that they have a mismatched appearance that is unacceptable if they are interconnected or if they are positioned immediately next to each other. Further, the interface and interconnection of the two different systems can be problematic, since the systems may not align due to an uneven floor, and further their connection can have a cluttered and "busy" appearance that is undesirable unless care is taken to assure that the connection has clean lines and/or is covered. Even if the original connection is acceptable, rearrangement may result in visible blemishes, screw holes, scratches, or other markings where the connections were previously made.

Accordingly, an integrated furniture system is desired solving the aforementioned problems, and yet which maintains the advantages of systems adapted for separate use and for rearrangement.

SUMMARY OF THE INVENTION

In one aspect of the present invention, an integrated furniture system for subdividing a building space is provided that includes an overhead framework system and a furniture-supporting partition system. The overhead framework system is constructed to provide a relatively open meeting area in the building space and to support activities therein. The overhead framework system includes at least one horizontally extending beam and posts supporting the beam overhead. The beam and posts have inner marginal surfaces defining a bounded space below the beam and between the posts, with the bounded space having a first height dimension and a first width dimension. The furniture-supporting partition system is also constructed to be used as a stand-alone system to subdivide a building space, such as by subdividing the building space into an arrangement of physically separated offices. The furniture-supporting partition system includes at least one partition having vertical side surfaces defining a second width dimension and horizontal side edges defining a second height dimension. The one partition includes at least a portion positioned in the space under the beam and being connected to the overhead framework system. In a narrower form, the partition is attached to the overhead framework system with a slip-fit connection.

In another aspect of the present invention, an integrated furniture system for subdividing a building space includes an overhead framework including a beam and a pair of posts supporting the beam overhead, with the beam and posts being interconnected and having inner marginal surfaces defining a bounded space below the beam and between the posts. The furniture system further includes a partition having top and bottom surfaces and vertical side edges defining dimensions shaped to fit into the bounded space.

The partition includes a leveler for adjustably leveling the partition on a floor surface. A slip-fit connector connects the partition to the overhead framework and is configured to permit adjustment of the partition relative to the floor surface without also having to adjust a height of the overhead framework. In a narrower form, the posts include a separate leveler that is separate from the first-mentioned leveler on the partition.

In yet another aspect of the present invention, an integrated furniture system for subdividing a building space includes an overhead framework system including a beam and a pair of floor-engaging posts supporting the beam overhead, the beam and posts being interconnected and having planar inner marginal surfaces defining a bounded space below the beam and between the posts. The integrated furniture system further includes a partition system with a partition having top and bottom side edges and vertical side edges defining dimensions shaped to fit into the bounded space. The partition is located completely within the bounded space and is attached to the framework, but includes floor-engaging supports for supporting the partition on the floor surface separate from the overhead framework system.

In yet another aspect of the present invention, an apparatus includes a first freestanding furniture system including an overhead framework and posts supporting the overhead framework. A space is defined under the overhead framework. A second freestanding furniture system includes partitions configured for rearrangement and interconnection for subdividing a building space into offices. At least one of the partitions is positioned at least partially in the space and is connected to the first freestanding furniture system for lateral support by a connector. The overhead framework includes first wireways for communicating wiring and utilities to the partitions, and the partitions include second wireways for receiving the wiring and utilities from the first wireways and for communicating the wiring and utilities to the offices.

These and other aspects, objects, and advantages of the present invention will be understood and appreciated by those skilled in the art by reference to the present specification, claims, and appended drawings.

BRIEF DESCRIPTION OF THE DRAWINGS

FIG. 15 is a fragmentary exploded perspective view of a floor channel and a leveler on the partition frame of FIG. 2 for engaging the floor channel;

FIG. 16 is a fragmentary end view of the floor channel and partition frame of FIG. 15 including the leveler engaged therewith;

DETAILED DESCRIPTION OF PREFERRED EMBODIMENTS

Figure 1:
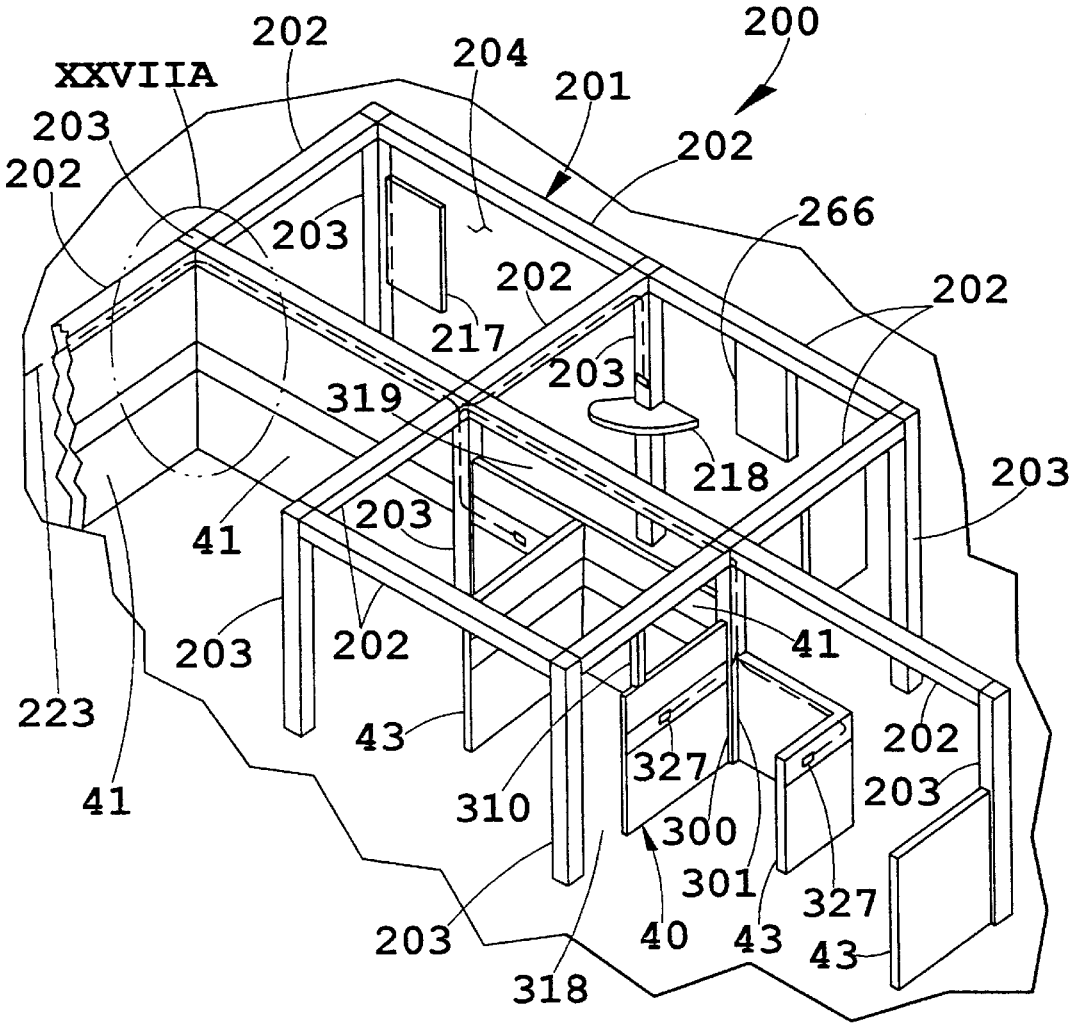
FIG. 1 is a perspective view of a furniture system embodying the present invention, including an overhead framework system and a partition system.

For purposes of description herein, the terms "upper," "lower," "right," "left," "rear," "front," "vertical," "horizontal," and derivatives thereof shall relate to the invention as oriented with the front of the partition frame being located adjacent a worker standing in front of the partition frame. However, it is to be understood that the invention may assume various alternative orientations, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

An integrated furniture system 200 for subdividing a building space (FIG. 1) embodying the present invention includes an overhead framework system 201 and a partition system 40 integrated to be used together or separately, or in a partially overlapping arrangement. The overhead framework system 201 is constructed to provide a relatively open meeting area, and includes at least one horizontally extending beam 202 and posts 203 supporting the beam 202 overhead. The beam 202 and posts 203 are interconnected to form a space 204 located directly below the beam 202 and between the posts 203, with the space 204 having a known width dimension and a known height (the height being adjustable within a given range). The partition system 40 is constructed to subdivide the building space into an arrangement of physically separated offices located under and around the overhead framework system 201. The partition system 40 includes partitions, such as a four-inch thick partition 41 and a two-inch thick partition 43, each having vertical side surfaces defining a second width dimension and horizontal side edges defining a second height dimension. The partitions 41 and 43 are positionable in the space 204 directly under the beam 202 with an in-fill member that closes all or part of the space 204. Alternatively, the partitions 41 and 43 can be positioned in and around the posts 203 and beams 202 as desired to construct offices thereunder. Advantageously, the partitions 41 and 43 are selectively connectable to either the posts 203 and/or beam 202 by slip-type connectors 300, 301, and 310. Thus, the framework system 201 can also be used to stabilize the partition system 40 from falling over, or the partition system 40 can be used to keep the framework system 201 upright and stable, yet each can be height adjusted and aligned. Specifically, the slip-type connectors 300, 301, and 310 permit vertical adjustment of the overhead framework system 201 and/or the partition system 40 without also having to vertically adjust the other system, thereby allowing independent adjustment and alignment.

Figure 20:
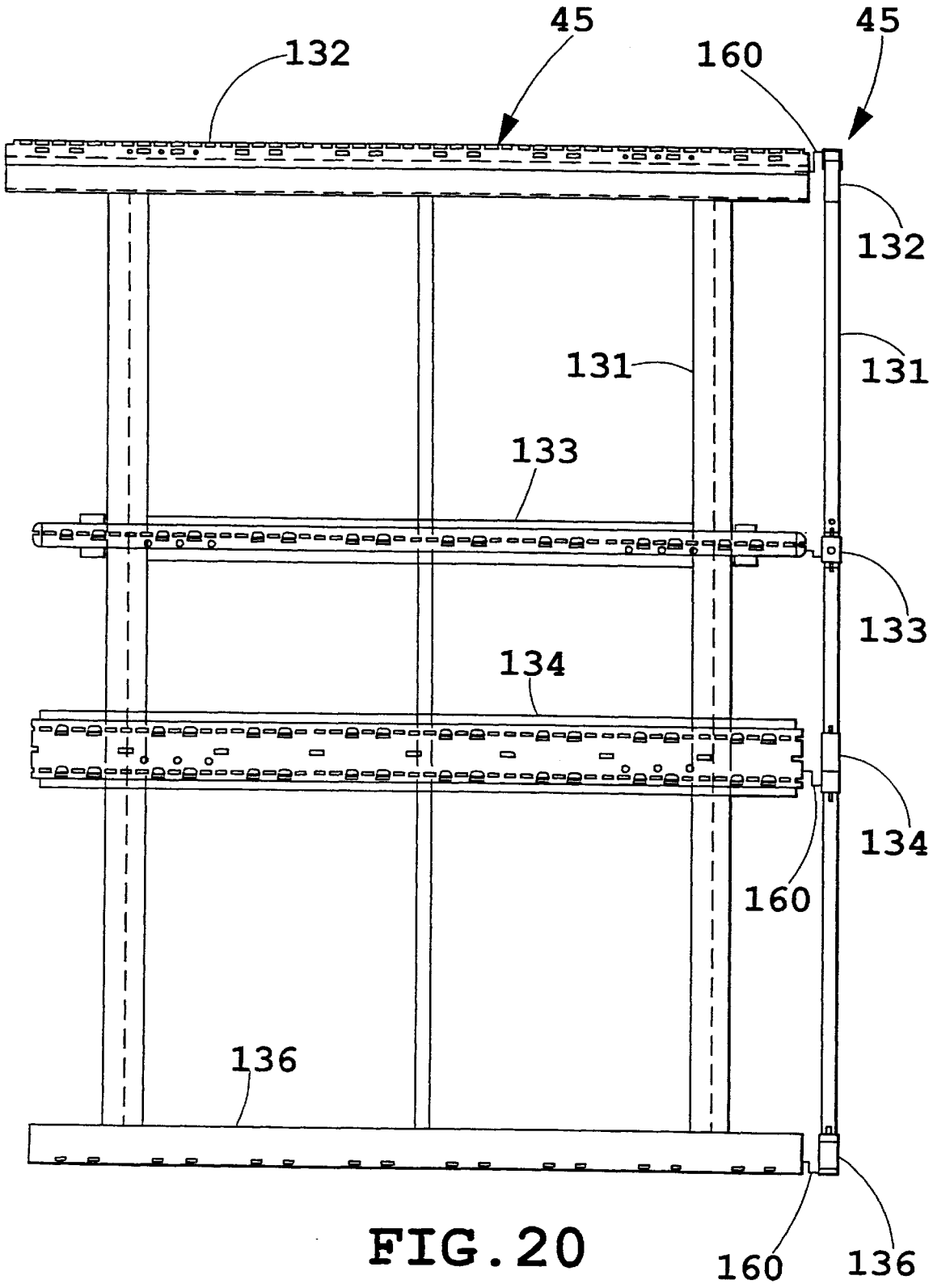
FIG. 20 is an end view showing an off-module connection of two partition frames from FIGS. 18 and 19.
Figure 21:
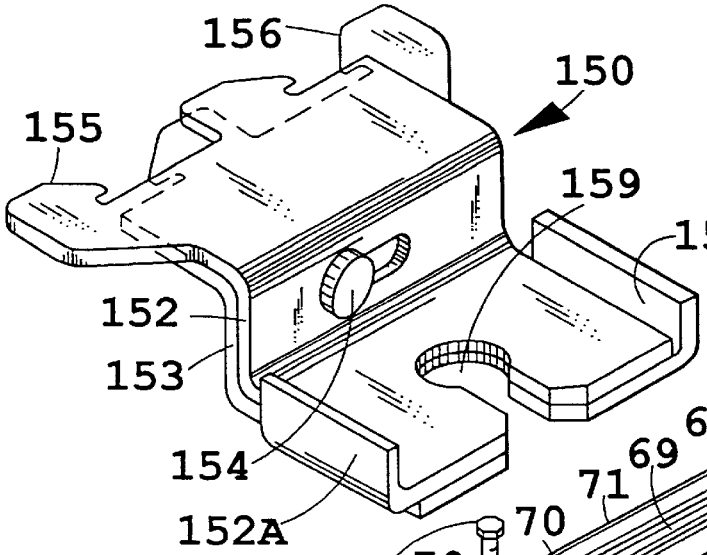
FIG. 21 is a perspective view of an off-module connector for interconnecting two four-inch partition frames of FIGS. 2–4 in an off-module connected arrangement.

A furniture system 40 (FIG. 1B) includes a freestanding partition panel system 41 comprising four-inch wide partition panels 42 (herein called four-inch Zonewall partition panels) and two-inch wide partition panels 43 (herein called two-inch Zonewall or Finwall partition panels). The partition panels 42 and 43 include a plurality of different height and width, pre-assembled frames, such as the illustrated base partition frames 44 and 45 (FIGS. 2 and 20), respectively, described below. A plurality of different size and type cover panels 73 (FIG. 1B) are attachable to the partition frames to aesthetically cover the sides thereof. The partition frames 44 and 45 are interconnectable in a myriad of different plan arrangements. Notably, in each of the plan arrangements, the partition panels are readily interconnectable in discrete locations to form accurately dimensioned office spaces of a selectable size without the need to carefully/accurately measure with a tape measure or order new parts. This feature, in combination with the highly flexible and accurate interconnection systems, makes the present freestanding partition panel system 41 very functional, markedly accurate, and also highly flexible/reconfigurable into a wide variety of arrangements. The interchangeability and rearrangeability reduces the need to order a substantial number of new components when reconfiguring the office plan. Also, the major components of each of the partition frames 44 and 45 are manufactured by roll-forming, such that their cost, when produced at high volumes, is generally very competitive and their cross-sectional accuracy and consistency is much better than for frame components made by stamping processes.

Four-inch base partition frames 44 (FIGS. 2–4) include at least two spaced-apart vertical uprights 46. A plurality of horizontal frame members 47–51 is attached to the uprights 46 at predetermined heights, as described below. The frame members 47–51 have front and rear faces spaced about three inches apart. The panel 42 becomes 3.8-inches thick upon attachment of cover panels 73 and four-inches thick upon attachment of trim components. Levelers 52 are operably attached to the bottoms of the uprights 46 and are configured to be releasably secured to floor channel 63 (FIG. 15). The partition frames 44 and 45 are provided in a variety of different heights and lengths in order to meet customer demands concerning functional and aesthetic considerations in a modem office or building area. Notably, base partition frames can be constructed with all of the above horizontal frame members 47–51, or with only selected ones of the horizontal frame members, such as with only frame members 47, 48, and 51.

Figure 4:
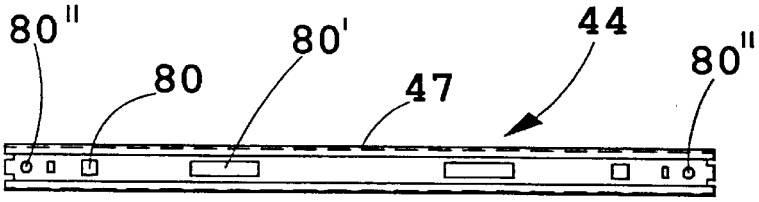
FIGS. 2–4 are side, end, and bottom views of a base frame shown in FIG. 1B.
Figure 2:
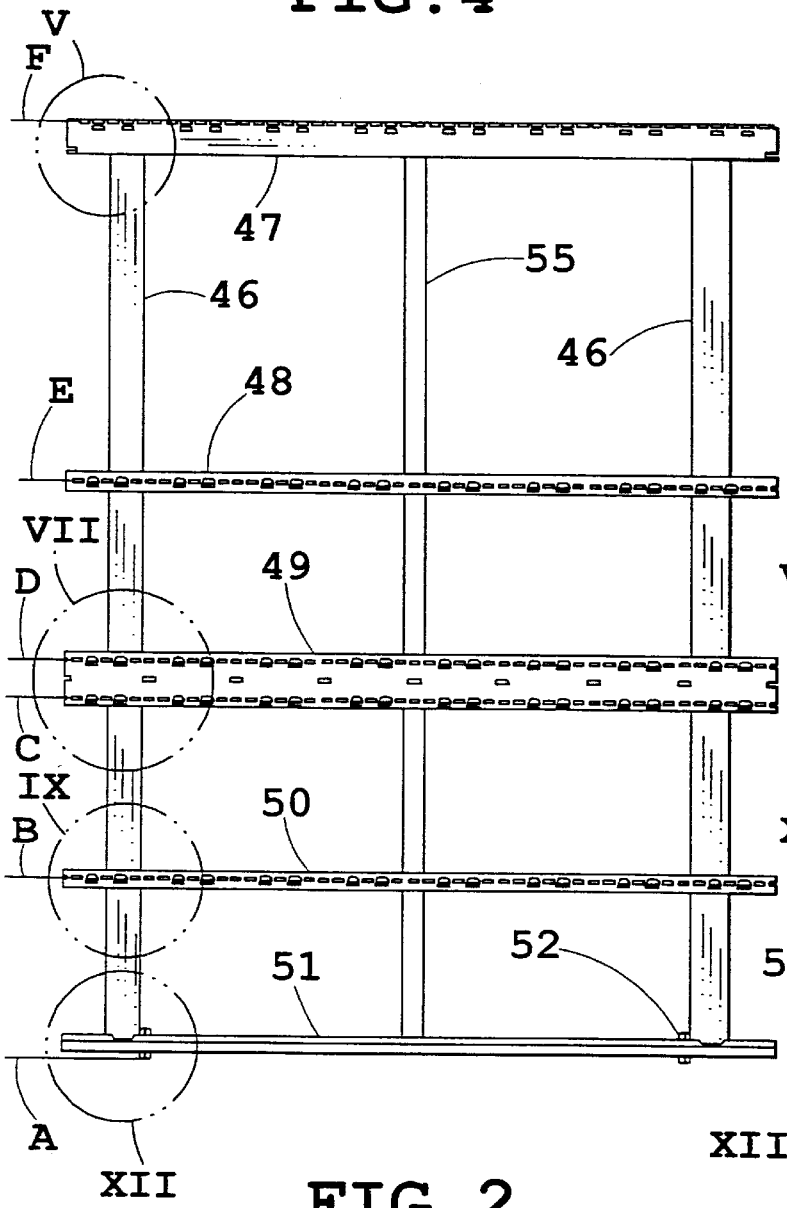
Figure 3:
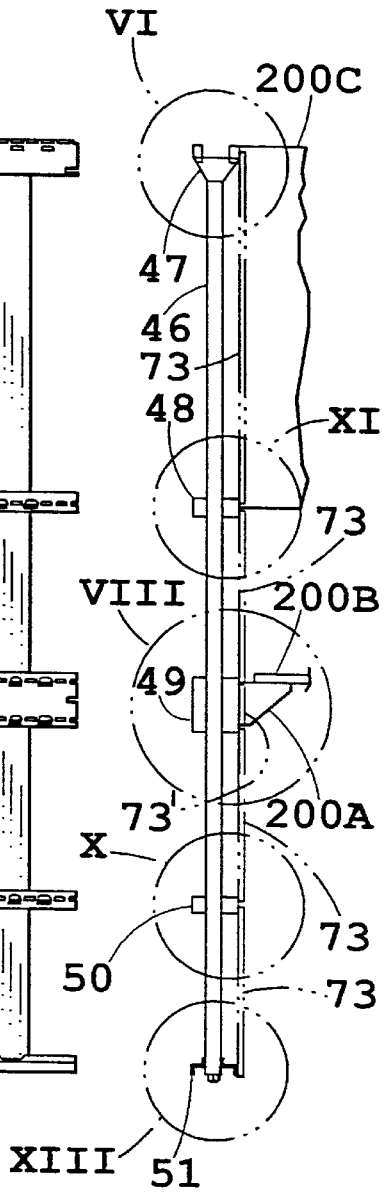
Figure 5:
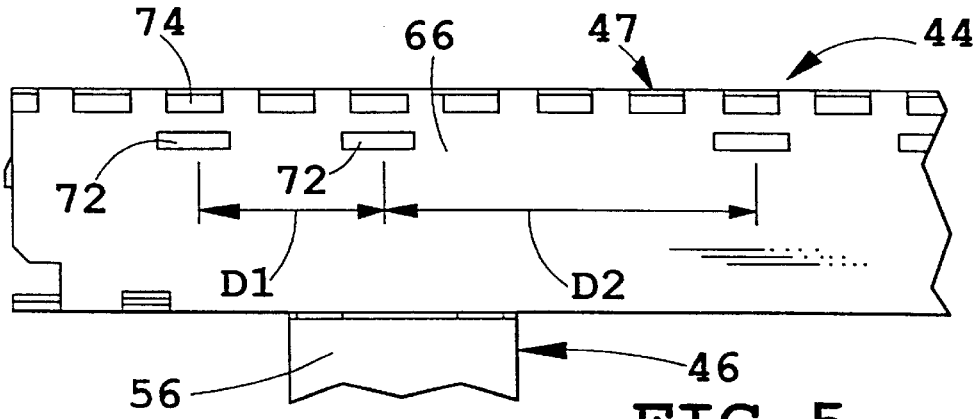
FIGS. 5–13 are enlarged fragmentary views of circled areas V through XIII in FIGS. 2–4.
Figure 12:
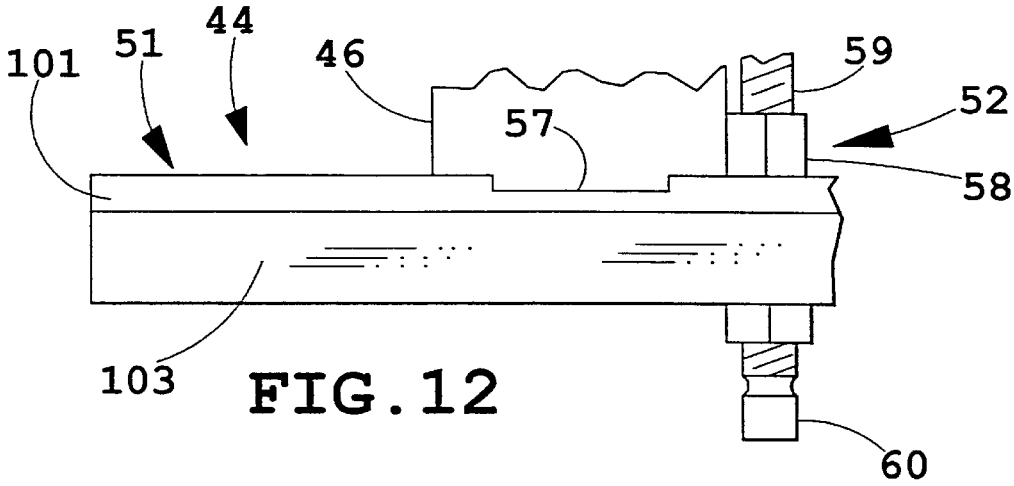

The outermost vertical uprights 46 (FIGS. 2 and 3) have rectangular cross sections. Intermediate uprights 55 are required when the horizontal span between uprights 46 reaches a relatively wide spanning distance. The spanning distance at which intermediate uprights are required depends on the functional requirements of the frame system and also on the material thickness and inherent strength of the partition frames. For example, intermediate uprights may be desired whenever the span between adjacent uprights reaches a distance greater than about two feet if the partition frame must support furniture components. Notably, the intermediate uprights 55 can be rectangular or, alternatively as shown in FIGS. 2–4, they can have a square cross section. The uprights 46 (and 55) extend continuously from top to bottom of the partition frames 44 and 45. The upper end 56 (FIG. 5) of the uprights is butt welded/MIG welded to a bottom of uppermost frame member 47, and the lower end 57 (FIG. 12) of the uprights is butt welded/MIG welded between the pair of lowermost frame members 51. This provides a rigid but open frame. It also facilitates accurate and efficient manufacture, since the uprights and horizontal frame members 47 and 51 can be accurately fixtured with the welding material taking up any dimensional variation in the length of the uprights. A leveler includes a leveler nut 58 and a leveler rod 59. The leveler nut 58 comprises a hex nut welded to an inboard side of the lower end 57 of each of the uprights 46 (and 55). A lower portion of the leveler nut 58 extends slightly below the lowermost frame member 51, and the threaded leveler rod 59 (FIG. 12) extends threadably through nut 58. The leveler rod 59 includes a configured end 60 shaped to matingly engage the small end of a keyhole aperture 61 (FIG. 15) in a hat-shaped section 62 of a floor channel 63. A clip 64 secures the leveler rod 59 in the small end, so that the leveler rod 59 is securely attached to the floor channel. When required by code, the floor channel 63 is secured in place by nailing, adhering, or otherwise fastening a bottom flange of the floor channel 63 to a building floor, so that the interconnected assembly of the partition frames 44 and 45 and floor channel 63 is resistant to damage/failure by a catastrophic event, such as an earthquake.

Figure 6:
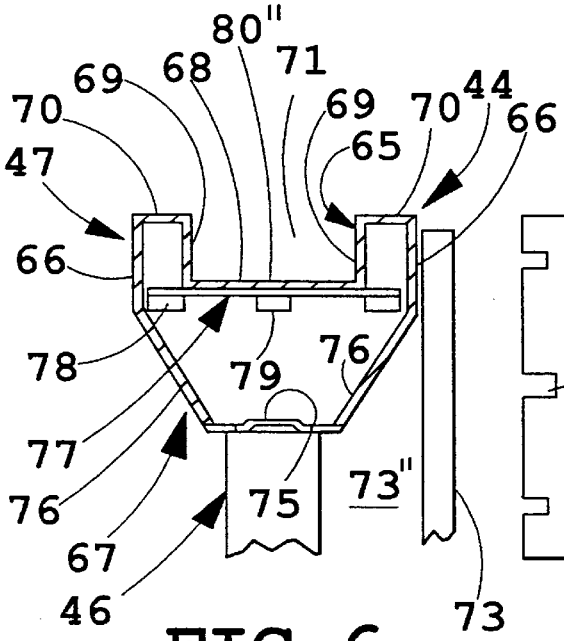
Figure 44:
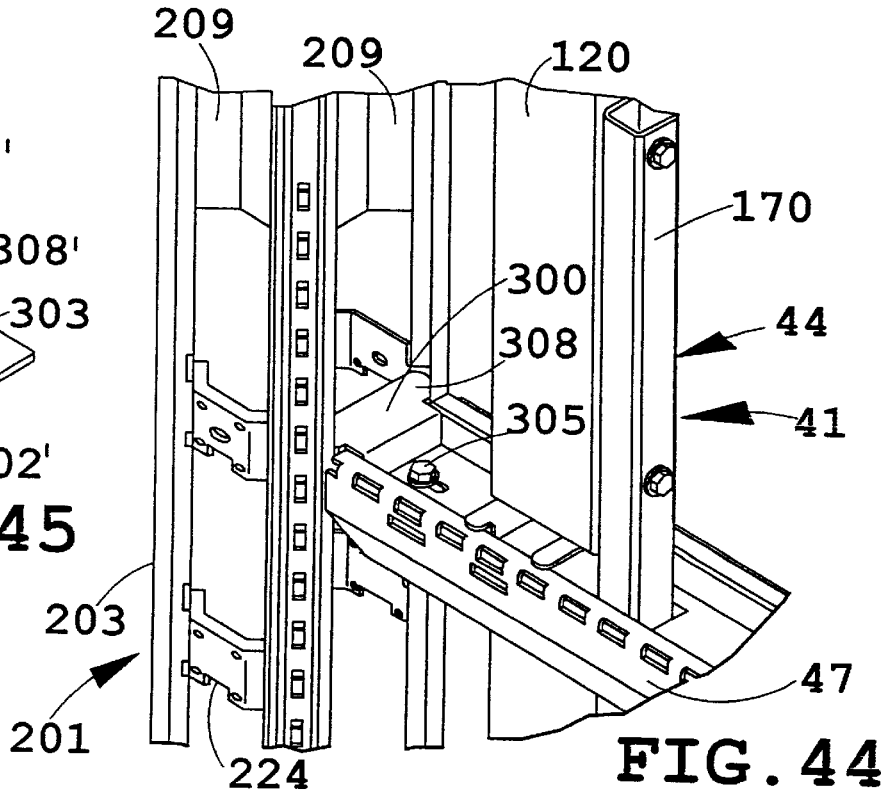
FIG. 44 is a perspective view of the connection shown in FIG. 43.

The top horizontal frame member 47 (FIG. 6) is tubular, and is roll-formed to provide a cost efficient manufacturing process. Top frame member 47 includes a top channel section 65, opposing apertured sidewall sections 66 connected to the edges of the top channel section 65, and a U-shaped support section 67 for supporting opposing sidewall sections 66. More specifically, top channel section 65 includes a center flange 68 with apertures 80 to permit stacking connection and apertures 80' to permit routing of wires therethrough. Opposing vertical inner flanges 69 extend from center flange 68, and horizontal top flanges 70 extend outwardly from center flange 68. The inner flanges 69 combine with center flange 68 to define an upwardly open channel or raceway 71 adapted to receive wires laid in from above. Sidewall sections 66 extend vertically downwardly from top flanges 70, and include cover-panel-supporting clip-receiving attachment apertures 72 (FIG. 5) for releasably receiving cover panel clip connectors (see FIG. 44). The cover panels 73 (FIGS. 1 and 27) comprise relatively flat panels adapted to cover the partition frames for aesthetics. Cover panels can be made from sheet metal, plastic, composite/particulate materials, other semi-solid or structural materials, or combinations thereof. The cover-panel-supporting apertures 72 (FIG. 5) occur in pairs that are spaced about two to three-inches apart "D1," preferably 2.7 inches, with the pairs being spaced regularly horizontally apart about every six inches "D2" along the sidewall section 66. The illustrated cover panels 73 include snap attach "carrot" shaped top connectors 183 and downwardly extending tab-like retainers 184 for engaging features on the partition frames 44 and 45 or on below-located cover panels 73, respectively.

A row of furniture-component-supporting hook-receiving attachment slots 74 extend horizontally along sidewall sections 66 just above apertures 72. The component-supporting slots 74 are adapted to receive horizontally oriented hooks on brackets for attaching furniture components to horizontal frame member 47, such as off-module attached partition frames, binder bins, shelves, and the like. The sidewall sections 66 are spaced outwardly from the sides of uprights 46 (and 55), so that a cavity is formed between an inside surface of panels 73 and uprights 46 (and 55), as discussed below.

U-shaped support section 67 (FIG. 6) of the top frame member 47 includes a flat bottom flange 75 and oppositely angled side flanges 76 that extend upwardly at about 60°. The angled side flanges 76 support the sidewall sections 66 at a location spaced outwardly from the sides of uprights 46 (and 55), so that the cover panels 73 are spaced from the uprights 46 (and 55) to create an internal cavity 73". This cavity 73" is noticeably open and provides an open interior space well adapted to receive a high density of utilities. The utilities can be flexibly routed to substantially any location within partition panel 42 or to adjacent frames, and can include bundled wires or conduit covered wires of about one-inch diameter. The angled side flanges 76 provide a strut-like support for supporting sidewall sections 66 with an optimal distribution of stress. This, in combination with the tubular shape of top horizontal frame member 47, allows the sheet material forming the top tubular horizontal frame member 47 to be optimized to a relatively thin gauge. Bottom and center flanges 75 and 68, respectively, include square apertures 80 and rectangular apertures 80' for routing wire therethrough. The uprights 46 (and 55) are welded to bottom flange 75 of support section 67.

The fact that top horizontal frame member 47 is tubular, and also the fact that it includes angled side flanges 76 along with its other flat flanges connected by work-hardened bends, causes top frame member 47 to be particularly strong and structurally stiff. This allows top frame member 47 to carry substantial weight, such as binder bins, shelves, and other hang-on furniture. The inherent strength of tubular top frame member 47 also stiffens the entire frame 44 against undesired bending and torsional deflection. As an example of the strength of tubular frame member 47 and its contribution to the strength of the frame 44, it is contemplated that the above-mentioned tubular top horizontal frame member 47 can be made from 18-gauge thickness (i.e., about 0.048 to 0.050-inches thick) and still acceptably/stably support a 400-pound weight cantilevered several inches in front of the center of the frame member 47, with the frame member 47 supported at its ends and spanning about 48 inches or more. The support of the 400 pounds is provided without an objectionable amount of torsional or translational deflection of the tubular top horizontal frame member 47 (based on conservative standards for load bearing, freestanding partition panels). This contrasts with conventional freestanding partition panels constructed to bear weight that typically are made of 16-gauge thickness (i.e., about 0.060-inches thick) in order to meet similar load/deflection standards.

A platform bracket 77 (FIG. 6) is optionally welded to an underside of center flange 68 of top channel section 65 inside of tubular top horizontal frame member 47. Bracket 77 includes stiffening flanges 78 on at least the side of each end, and further includes an extruded hole 79 that aligns with a hole 80" in center flange 68. The extruded hole 79 is located a short distance (i.e., an inch or so) from the end of center flange 68. The bracket 77 reinforces center flange 68. The extruded hole 79 threadably engages a screw 144 (FIG. 22) for providing both in-line connection and off-module connection (see FIGS. 21–23A) of partition frames, as described below.

The pair of vertically aligned square apertures 80 (FIG. 4) are located in center flange 68 and bottom flange 75 (FIG. 6) near the ends thereof at a location inboard of but vertically proximate the ends of uprights 46 (and 55). The apertures 80 are configured to closely receive a tubular stacker bracket 170 (see FIG. 26) that attaches to the inboard side of an upright 46 (and 55) of base frame 44 and is an inboard side of an upright 121 of a stacker frame 120. The stacker frame 120 is substantially identical to base frame 44, but includes a bottom modified by eliminating the leveler nut and rod 58 and 59, respectively.

Figure 7:
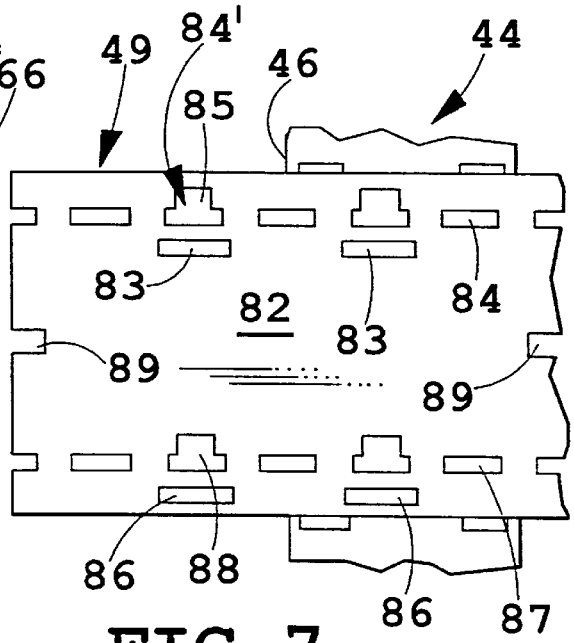
Figure 8:
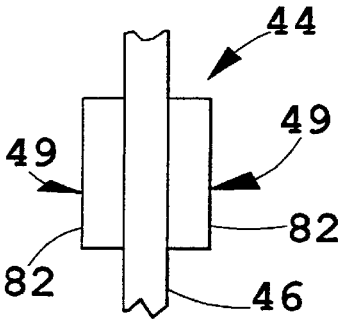
Figure 25:
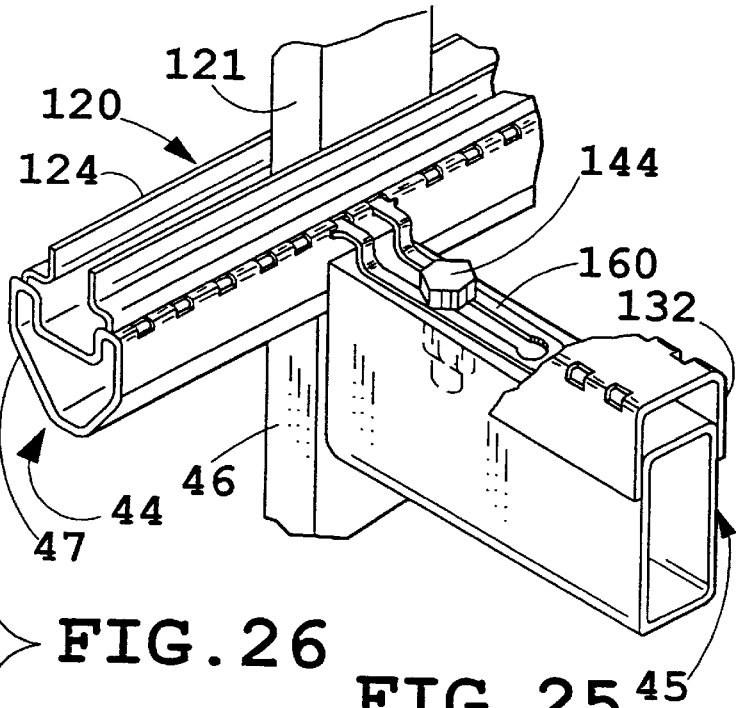
FIG. 25 is a fragmentary perspective view, partially broken away, of a two-inch partition frame of FIGS. 17–19 connected off-module to a four-inch partition frame of FIGS. 2–4 using the off-module connector of FIG. 24.

The belt-high horizontal frame members 49 (FIGS. 7 and 8) include two rectangular tubes MIG welded on opposite sides of uprights 46 (and 55). The frame members 49 each include an outer planar face 82 defining a row of panel-cover-supporting apertures 83 proximate a top of the frame members 49 for releasably receiving cover panel clip connectors. As with apertures 72 above, the cover-panel-supporting apertures 83 occur in pairs that are spaced about two inches apart, and the pairs are spaced regularly horizontally about every six inches along the outer planar face 82. A row of furniture-component-supporting hook-receiving slots 84 extend horizontally along faces 82 just above cover-panel-supporting apertures 83. The component-supporting slots 84 are adapted to receive horizontally oriented hooks on brackets (e.g., off-module connector 150 (FIG. 22), or off-module connector 160 (FIG. 25)) for attaching furniture components to horizontal frame members 49, such as off-module attached partition frames, binder bins, shelves, and the like. The particular component-supporting slots 84' (FIG. 7) located above cover-panel-supporting apertures 83 can include a vertically extending up notch 85 that can be used to access an inside of frame member 49. Another row of cover-panel-supporting clip-receiving apertures 86 and another row of component-supporting slots 87 extend horizontally along a lower portion of frame member 49. The pattern of apertures/slots 86 and 87 are identical to the pattern of apertures/slots 83 and 84 and are vertically aligned therewith.

The arrangement of apertures/slots allows cover panels 73 to be attached to the frame 44 in different arrangements. Several such cover panel arrangements are shown in FIG. 1B. For example, a single cover panel can be attached that completely covers the frame 44 from top to bottom. If an intermediate clip is needed to retain the cover panel to the frame 44, then it is positioned to engage one of the apertures 83 or 86. Alternatively, a partial height top cover panel can be attached to frame 44 with its bottom edge located just above bottom slots 87. For example, in the partial height arrangement, attachment clips on the top partial height cover panel engage notches 85. A partial height bottom cover panel is then attached that has a top edge located just below the bottom component-supporting slots 87. This leaves the bottom component-supporting slots 87 continuously exposed, even with the top and bottom cover panels on the frame 44. Thus, furniture components can be attached to or removed from the frame 44 without disturbing the cover panels 73.

In still another alternative (see FIG. 3, covers shown in phantom lines), a partial height top cover panel 73 has a bottom edge that is located above the top component-supporting slots 84, and a partial height bottom cover panel has a top edge that is located below the bottom component-supporting slots 87. A short-height concave beltway panel cover 73' of about three inches in height or so is attached between the cover-panel-supporting apertures 83 and notches 88, leaving the component-supporting slots 84 and 87 exposed. In such arrangement, furniture components can be attached to one or both of the slots 84 and 87, even while the concave three-inch cover panel is still attached. This double set of component-supporting slots 84 and 87 is particularly advantageous for use to support shelf-supporting cantilevered brackets 200A and shelves 200B (FIG. 3) in front of horizontal frame member 49. Notably, a fifth row of apertures 89 is located longitudinally along a centerline of face 82 at six-inch spaced-apart intervals. These apertures 89 are engaged by spring clips on the beltway panel cover to hold the beltway cover on frame 44. When installed, the outer surface of the beltway cover is flush with cover panels 73 or can be recessed therefrom. Even with cover panels 73 attached, the furniture-component-supporting slots (e.g., slots 84 and 87) can be accessed by hooked brackets to support binder bins 200C (FIG. 3) or the like.

Figure 9:
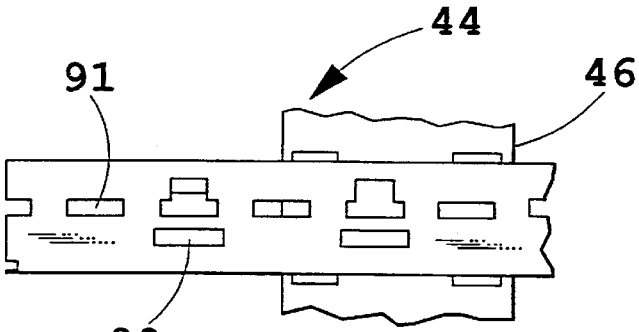
Figure 10:
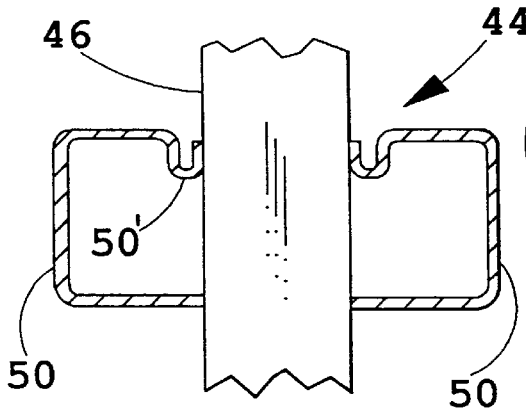
Figure 11:
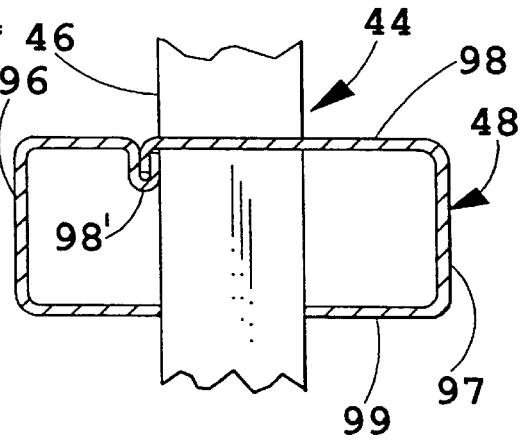

The knee-high horizontal frame members 50 (FIGS. 9 and 10) comprise a pair of inwardly facing C-shaped channels welded onto opposite sides of uprights 46 (and 55). A stiffening rib 50' is optionally formed on the C-shaped channel if needed. In still another alternative, a bracket is welded or secured to the uprights 46 (and 55) having outwardly extending legs, and the C-shaped channels are hooked onto legs of the brackets. In still a third alternative, the frame member 50 is a single rectangular tube, much like frame member 48 in FIG. 11, described below. Regardless of their particular cross-sectional shape, it is contemplated that the frame member 50 will have a pattern of cover-panel-supporting apertures 90 and component-supporting slots 91 that form an identical pattern to the cover-panel-supporting apertures 83 and component-supporting slots 84 on belt-high horizontal frame member 49. The purpose and function of the cover-panel-supporting apertures 90 and component-supporting slots 91 are identical to cover-panel-supporting apertures 83 and component-supporting slots 84.

The shoulder-high horizontal frame member 48 (FIG. 11) is used where the uprights are so long that the top horizontal frame member 47 is spaced significantly above belt-high horizontal frame member 49. The shoulder-high horizontal frame member 48 is also desirable where an intermediate support for furniture components is desired. The frame member 48 is a rectangular tube having opposing apertured planar side faces 96 and 97 that are identical to the outward faces of knee-high horizontal frame members 50. However, horizontal frame member 48 is rectangular and includes top and bottom horizontal transverse flanges 98 and 99 that extend from front to rear of frame 44, and also includes interconnecting side faces 96 and 97. The top and bottom horizontal flanges 98 and 99 are cut out to form apertures at their ends and middle to mateably receive and engage uprights 46 (and 55). It is noted that the bottom flange 99 can comprise two separate and unconnected flange sections that terminate in inward edges that abut the outboard sides of the uprights 46 (and 55). Also, the top flange 98 can include a doubled-back stiffening rib 98' formed to lie adjacent an edge of the uprights 46 (and 55). The top and bottom flanges 98 and 99 are MIG welded or otherwise securely attached to uprights 46 (and 55).

Figure 13:
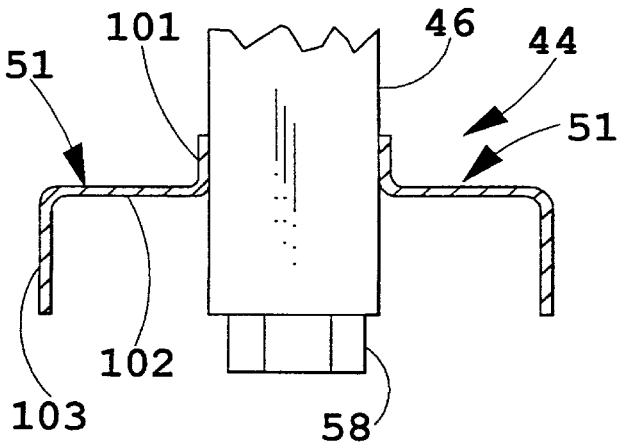
Figure 14:
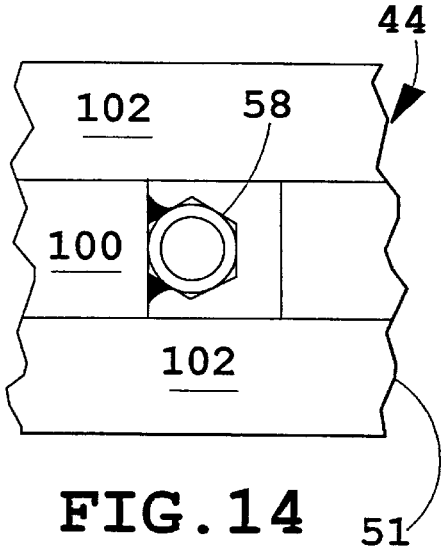
FIG. 14 is a fragmentary bottom view of FIG. 12.

The floor-adjacent horizontal frame member 51 (FIGS. 12 and 13) are opposing Z-shaped members, having an inner flange 100 for engaging uprights 46 (and 55). Lateral flanges 102 extend horizontally from inner side flanges 101, and outer vertical side flanges 103 extend vertically from lateral flanges 102. Floor-adjacent horizontal frame member 51 can include cover-panel-supporting apertures and component-supporting slots similar/identical to cover-panel-supporting apertures 83 and component-supporting slots 84 if desired (see FIG. 7). In the illustrated embodiment, the bottom edge of vertical side flanges 103 is constructed to engage bottom cover panel connector clips 184 to retain a lower edge of the cover panels 73 attached at the bottom of the frame.

An exemplary floor channel 63 is shown as supporting a base partition frame 45 in FIGS. 15 and 16. A similar floor channel can be constructed for engagement with a base partition frame 44. Floor channel 63 (FIG. 15) includes a center hat-shaped section 62 with a raised center flange, inner side flanges 108, and a bottom flange 108'. Flanges 109 extend horizontally outwardly from inner side flanges 108, and freestanding outer flanges 110 extend upwardly from the edges of floor-engaging flanges 109. The outer flanges 110 include component-supporting slots 112 for receiving furniture-component brackets. Also, the upper edge 113 of outer flange 110 is adapted to releasably receive friction/snap-attach connectors 114 on a baseboard-simulating cover plate 115. It is noted that the present floor-channel attachment system can be used on a variety of different floor channel configurations, including those having a relatively flat and wide floor-engaging flange that extends completely from a front to a rear of the floor channel.

The component-receiving apertures of the horizontal frame members 47–51 are strategically positioned to reflect a predetermined vertical dimensional logic. Further, the horizontal frame members 48–51 are fixtured relative to the top flat surface of the top frame member 47 and are accurately located relative to the apertures 72 and slots 74, so that the vertical dimensional spacing of all apertures in frame members 47–51 is accurately controlled. Notably, this arrangement allows the length of uprights 46 (and 55) to vary without adversely affecting the location of the various apertures. Specifically, as shown in FIG. 2, the apertures are located so that a dimension of about 12 to 13 inches exists between apertures at location A and location B, between location B and location C, and between location D and location E. Also, the distance between location E and location F in the illustrated frame 44 is twice the dimension between locations A and B. This allows a "1X" cover panel having a dimension equal to the distance A-B to be used to cover any of the spans from locations A-B, B-C, or D-E. A "2X" or double-height-type cover panel can be used to cover spans from locations A-C or E-F. A "1X plus" cover panel can be used to span locations B-D or locations C-E. A "2X plus" cover panel can be used to span locations A-D or locations B-E. Notably, the overall height of partition frames 44 can be varied. In such case, it is advantageous to design the top frame member 47 to be at a height that is above the next-to-top horizontal frame member by a distance equal to the distance B-C, or by the distance B-D, or some logical multiple/variation thereof. This advantageously allows a relatively limited number of cover panels to cover all different partition frame constructions while still being able to achieve desired ergonomically correct space division heights. Thus, this scheme greatly reduces inventory management in the factory and on-site, simplifies ordering and shipping, and also greatly simplifies manufacturing, particularly since the cover panels can be covered with a myriad of different materials and/or different structural compositions.

The partition panels 42 can also include a stacker frame 120 (FIG. 26) adapted to be stacked above the base partition frames 44. Exemplary stacker partitions are shown in U.S. Pat. No. 5,943,834, the entire contents of which are incorporated herein by reference.

Figure 17:
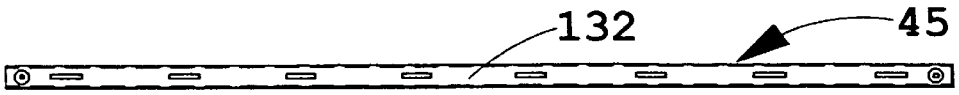
FIGS. 17–19 are top, side, and end views of a two-inch wide frame embodying the present invention.
Figure 18:
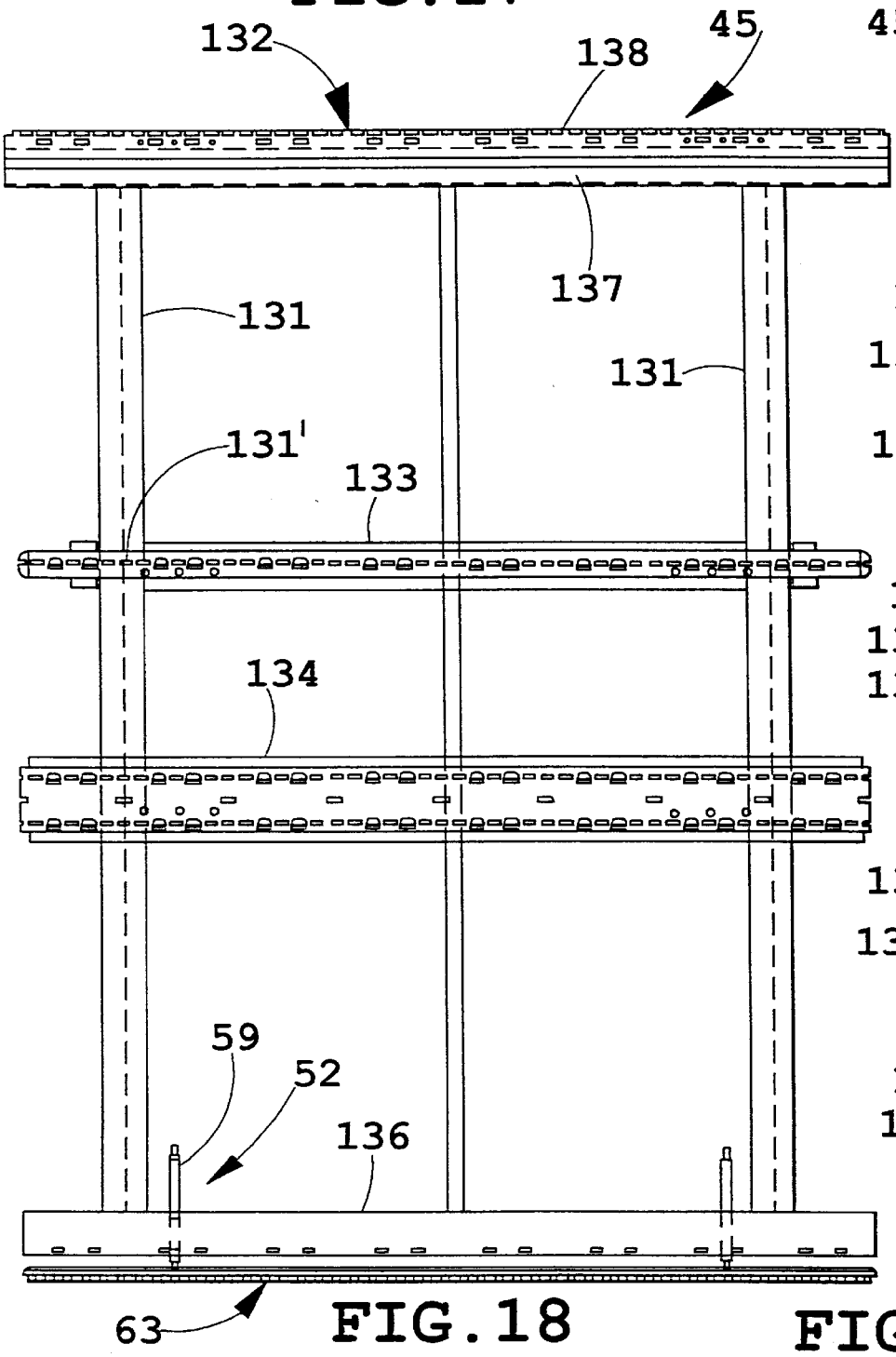
Figure 19:
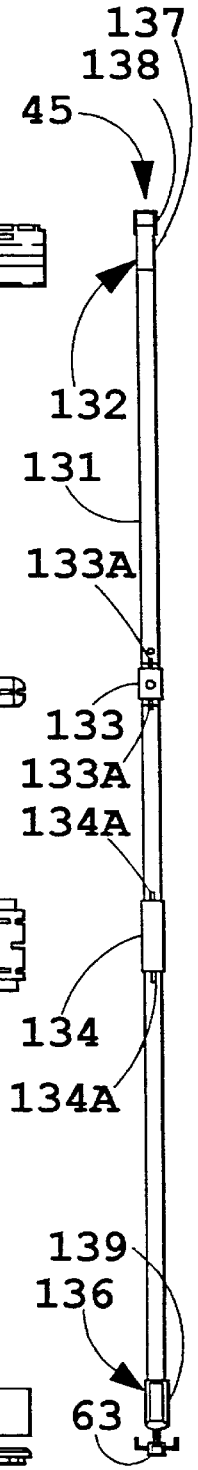

Briefly, the present modified two-inch partition panel 43 (which becomes "two inches" only after attachment of the cover panels) includes a partition frame 45 (FIGS. 17–19) having uprights 131 similar to uprights 46 (and 55) of Zonewall partition frame 44. However, the horizontal frame members 132–134 and 136 have a narrow width that only exceeds the width of the uprights 131 by two thicknesses of sheet metal, one thickness being on each side of the uprights 131 at location 131', for example. Thus, the partition panel 43 formed by attachment of cover panels 73 to the sides of partition frame 45 is only about two-inches thick in total width. Notably, the same cover panel 73 can be attached to two-inch frame 45 as is adapted to attach to four-inch frame 44. The top horizontal frame member 132 includes a rectangular tubular member 137 and a U-shaped channel 138 welded to the tubular member 137. Bottom horizontal frame member 136 similarly includes a rectangular tubular member 139. A U-shaped channel (not shown) similar to U-shaped channel 138 can be welded to a bottom of the tubular member 139 if desired. The intermediate horizontal frame members 133 and 134 each comprise opposing hat-shaped channels having notches cut away to receive the uprights 131. The legs 133A and 134A of opposing ones of the hat-shaped channels abut and are welded together to the uprights 131. Connector-receiving apertures for supporting cover panels 73, and also hook-receiving slots for receiving hooked brackets to support furniture components, are formed in the sides of the horizontal frame members 132–134 and 136. It is contemplated that a pattern of apertures/slots similar to those found on partition frames 44 will be formed in frames 45, although various aperture/slot patterns are possible. Typically, the horizontal frame members of partition frame 45 horizontally align with the horizontal frame members of the partition panel 43, although this is also not absolutely necessary.

Figure 22:
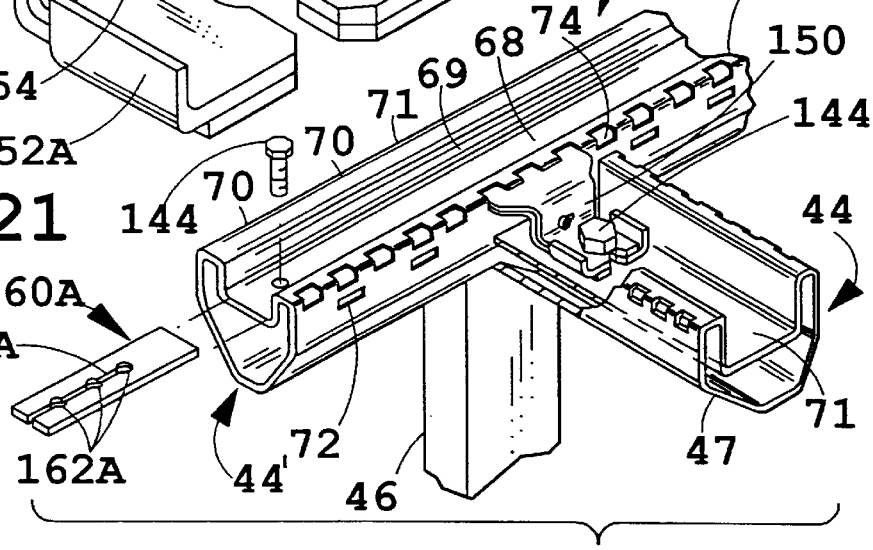
FIG. 22 is a fragmentary view, partially broken away, of a top of a first four-inch partition frame interconnected to a top of a second four-inch partition frame in an off-module connected arrangement and showing an in-line connector for use therewith.
Figure 23:
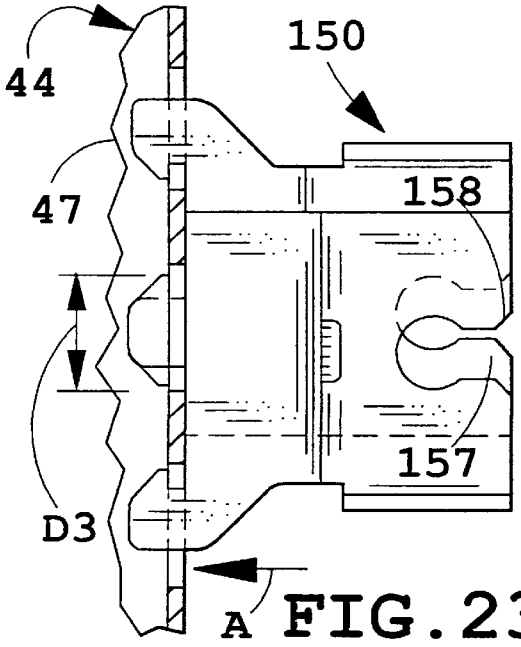
FIGS. 23 and 23A are fragmentary top views of an off-module connector that is connected to a partition frame, the off-module connector being in an unlocked/released position in FIG. 23 and in an interlocked/engaged position in FIG. 23A.
Figure 23A:
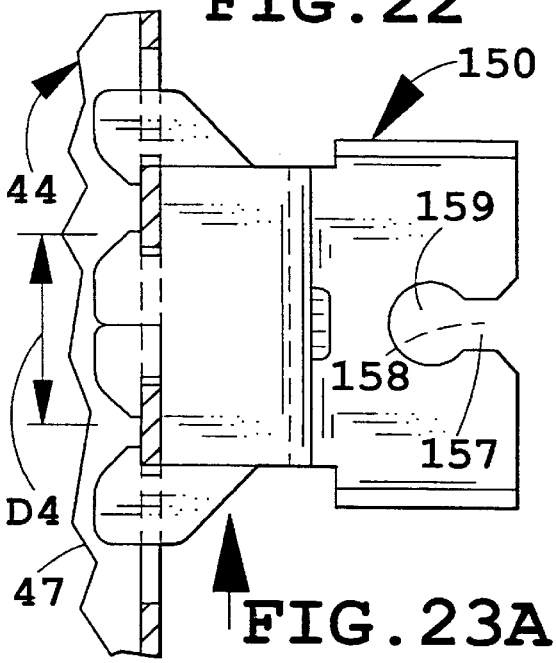

Off-module connector 150 (FIGS. 21–23A) is constructed to connect a four-inch Zonewall partition frame 44 to another such partition frame 44' (FIG. 22). Off-module connector 150 (FIG. 21) includes a pair of Z-shaped plates 152 and 153 slidably secured together by a rivet 154. One plate 152 includes a pair of hooks 155 oriented laterally/horizontally in a first direction, and the other plate 153 includes a second pair of hooks 156 oriented laterally/horizontally in a second direction opposite the first direction. The hooks 155 and 156 are configured to overlap to define a narrow dimension D3 when the plates 152 and 153 are shifted to one side to a release position (FIG. 23). In the release position, the hooks 155 and 156 are collapsed and can be inserted into the furniture-component-supporting slots in direction A, such as slots 84. When shifted in an opposite direction to an interlocked/engaged position (FIG. 23A), the hooks 155 and 156 are spread apart to a dimension D4 and securely engage the material forming the furniture-component-supporting slots. Slots 157 and 158 are located at the end of plates 152 and 153 opposite the hooks 155 and 156. These slots 157 and 158 align when the plates 152 and 153 are slid to the interlocked/engaged position. The slots 157 and 158 include an enlarged end forming a pocket 159 for receiving and capturing/retaining a shaft of a screw 144. As previously described, the screw 144 engages an extruded hole in the partition frame 44. The Z-shape of the connector 150 is configured to position the slotted end of plates 152 and 153 at a height adjacent the extruded hole on frame 44 that screw 144 engages (FIG. 22). Tabs 152A and 153A are provided on the edges of plates 152 and 153 to facilitate unlocking and locking the plates 152 and 153.

Figure 24:
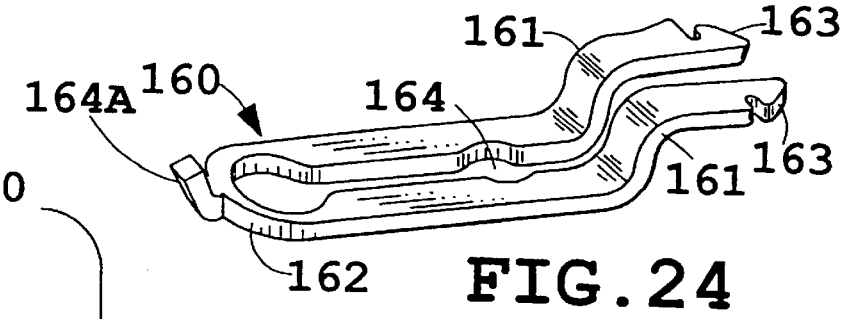
FIG. 24 is a perspective view of an off-module connector for interconnecting the two-inch partition frame of FIGS. 17–19 to another partition frame of FIGS. 2–4 in an off-module connected arrangement.

A second off-module connector 160 (FIGS. 24 and 25) is used for off-module interconnection of Finwall partition frames 45. Briefly, the off-module connector 160 includes a pair of legs 161 resiliently connected together by a resiliently flexible looped end 162. The legs 161 have opposing hooks 163 at their free ends adapted to engage furniture-component-supporting slots in frames 44 or 45. The legs 161 are Z-shaped for locating the spring end 162 at a predetermined height relative to the slots in frames 44 or 45, so that end 162 is positioned adjacent an extruded hole and screw 144. A slot is defined between legs 161 including an enlarged region defining a pocket 164 for receiving the shaft of screw 144. When the shaft of screw 144 is located in pocket 164, the shaft is captured, and further the legs 161 are forced apart to securely non-releasably engage the slots to which they are attached. As with the four-inch partition frame 44, two or more of the off-module connectors 160 will typically be used to secure a Finwall partition frame 45 to a main/spine partition frame, one at a top and one at a bottom of frame 45. A tab 164A extends from looped end 162 for engaging a detail on the frame 45 to maintain connector 160 in longitudinal alignment with the horizontal member to which it is attached.

An in-line connector 160A (FIG. 22) comprises a plate having a slot 161A with recesses 162A for receiving screws 144 to secure it to aligned top frame members 47 on center flanges 68 of aligned panels 43. The recesses define extended and retracted/storage positions of the in-line connector 160A. The in-line connector 160A fits snugly between the inner flanges 69 when positioned on center flange 68 to aid in alignment.

Stacker bracket 170 (FIG. 26) is used to securely connect a stacker frame, such as stacker frame 120, to a base partition frame 44. The stacker bracket 170 is a length of a square tube. Two spaced-apart upper attachment holes 171 and two spaced-apart lower attachment slots 171' are formed in bracket 170, two at each end. The two slots 171' at the bottom align with holes in the top of the uprights 46 (and 55) of base partition frame 44, and the holes 171 at the top align with holes in the bottom of the upright 121 of stacker partition frame 120. Bolts 172 are extended through the holes for clamping the stacker bracket 170 to the respective uprights 46 (and 55) and 121.

Figure 27:
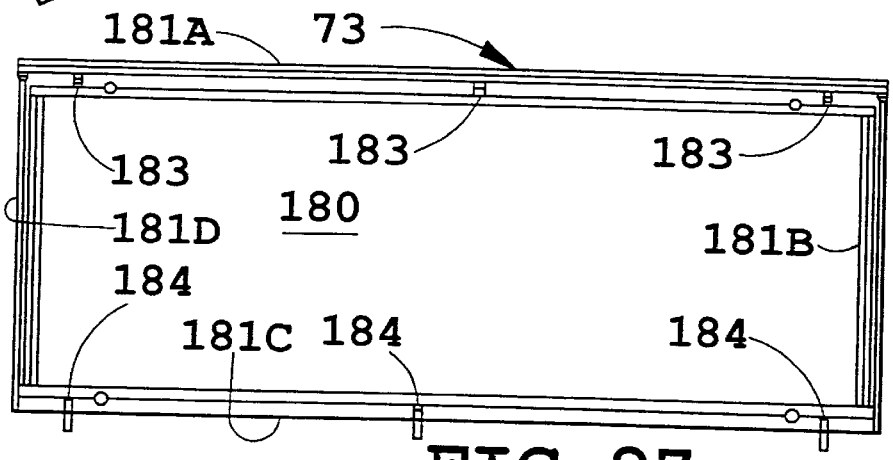
FIG. 27 is a plan view of an inside of the cover panel shown in FIGS. 1B and 6 for covering the partition frames of FIGS. 2, 15, and 18.
Figure 27A:
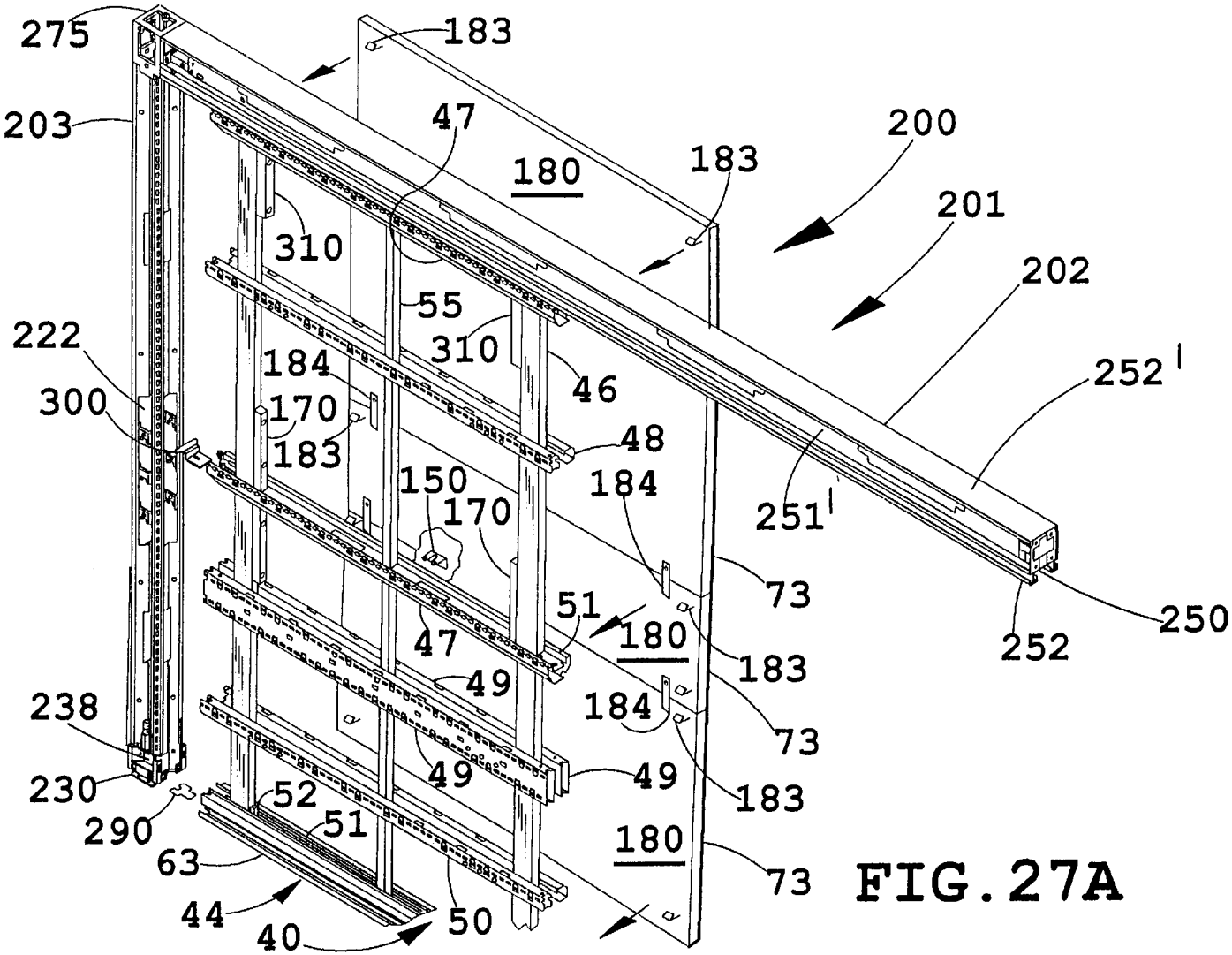
FIG. 27A is an exploded perspective view of the circled area XXVIIA in FIG. 1, including the frame and one cover of the partition and the frames and some covers of the post and beam.

Cover panel 73 (FIG. 27) includes a large flat panel 180 made from any number of different materials, such as sheet metal, plastic, particulate materials, composite materials, and combinations thereof. The illustrated cover panel 73 includes roll-formed sheet metal edging 181A–181D to protect, form, and strengthen the marginal edges of flat panel 180. The edging 181A–181D is configured along its perimeter to receivingly engage and support cover-panel-supporting resilient snap-in top connectors or clips 183, and cover-panel-supporting bottom tab-like connectors or retainers 184. Three such top clips 183 and bottom retainers 184 are shown in FIG. 27, although more or less can be added as needed for functional reasons. Also, additional clips or retainers can be added along the vertical side edges 181B and 181D of cover panel 73, such as where the cover panel extends a significant vertical distance and where it is desirable to hold the middle of the cover panel to the underlying frame. The top clip 183 interlockingly snap into apertures in the frames 44. The illustrated bottom tab-like retainers 184 fit behind an upper edge of a cover panel 73 therebelow.

When attached, opposing cover panels 73 define an internal cavity within the frame 44 that extends horizontally the width of the partition frame, and substantially the entire height of the frame 44 (FIG. 3). Wires can be laid in to the internal cavity and can be routed around uprights between the uprights and an inner surface of the cover panels. Notably, the space between the outer surface of the uprights and the inner surface of the cover panels is about one inch and is located substantially outboard of the upright outer surface, such that conduit-covered wires that are ¾ of an inch or more can be easily routed along and around the internal cavity. Since the uprights are about one-inch thick, the internal cavity is a total of about three-inches thick for a four-inch partition panel 42 having a partition frame 44.

It is also contemplated that clips 183 and/or retainers 184 can be used to attach a cover panel to vertical frame members as well. For example, cover panels incorporating the clips 183 and/or retainers 184 could be attached to Steelcase Series 9000 partition panels, which panels are well-known in the industry. The snap-in antidislodgement feature on clip 183 is particularly useful where secure attachment, but releasable attachment, of cover panels is desired, such as to resist failure from a catastrophic event (e.g., earthquakes).

Figure 28:
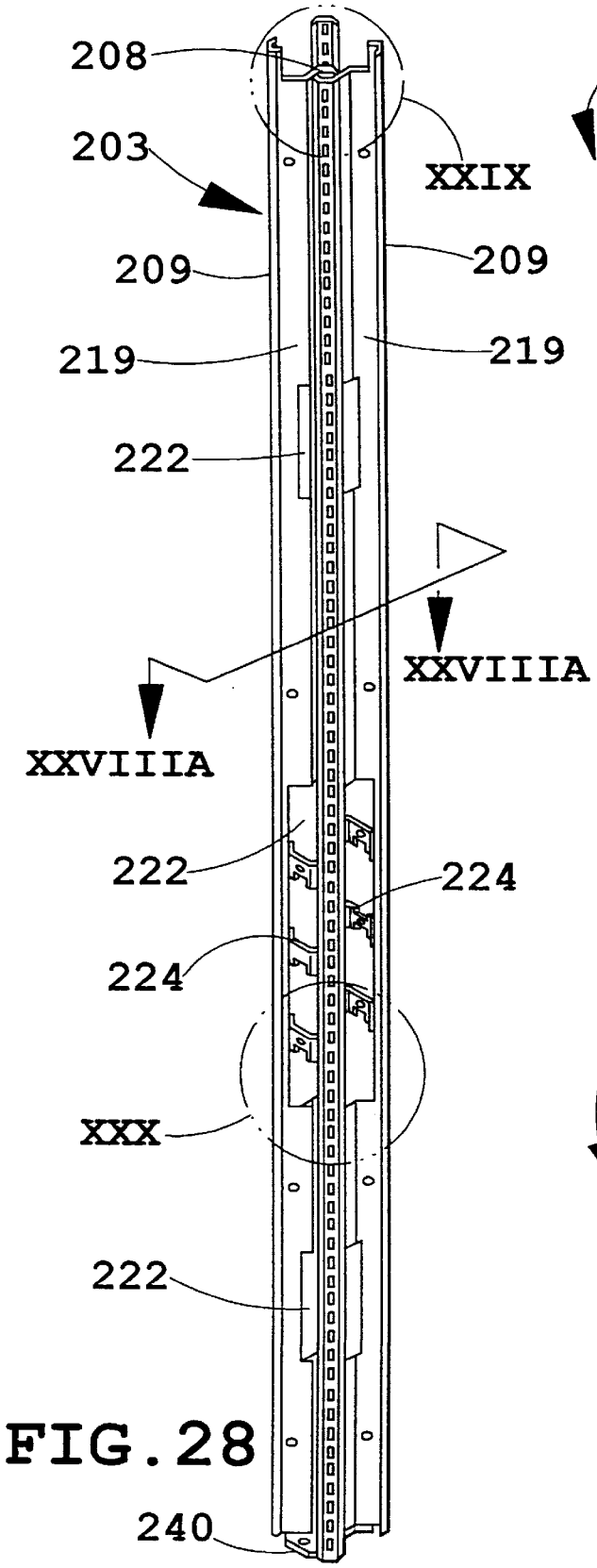
FIG. 28 is a perspective view of the post shown in FIG. 27A.
Figure 29:
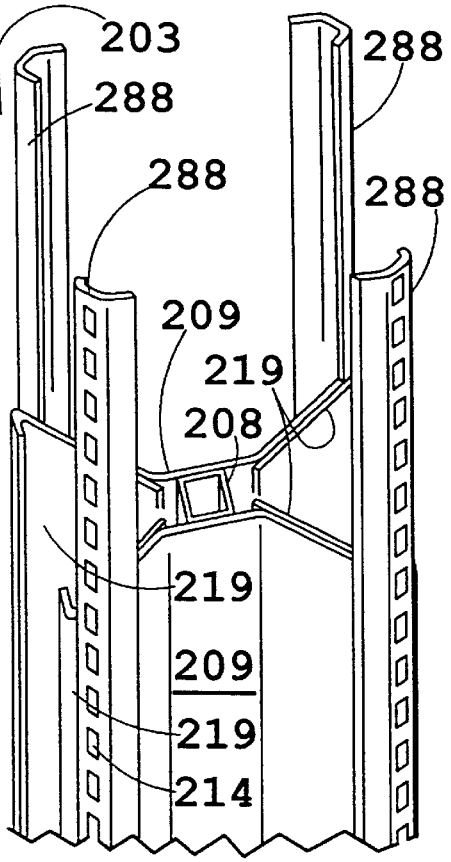
FIG. 29 is an enlarged perspective view of the circled area XXIX shown in FIG. 28.
Figure 30:
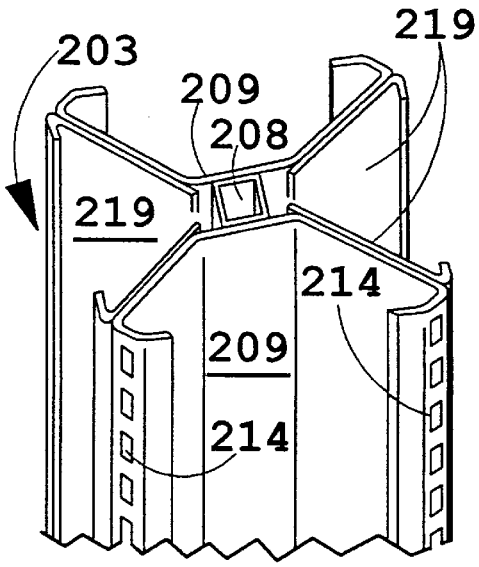
FIG. 30 is an enlarged perspective view of the circled area XXX shown in FIG. 28.

As noted above, the overhead framework system 201 comprises a separate stand-alone system. The column or post 203 (FIG. 28A) of the framework system 201 includes a square center tube 208 that extends from a top to a bottom of the post 203, and further includes two C channels 209 welded to opposite sides of the center tube 208. The channels 209 each include a center flange 210, two radially extending flanges 211 that extend at 45° outwardly, two outer flanges 212 that extend perpendicularly to the radially extending flanges 211 and that form four corners to the posts 203, and two stiffening/terminating flanges 213. The outer flanges 212 include a vertical row of slots 214 for receiving hooks 215 (FIG. 39) on furniture-supporting brackets 216 and 216'. The furniture can be any number of different items, such as hanging signs or screens 217 (FIGS. 1 and 39), tables 218 (FIG. 1), or other furniture items. J-shaped stiffening strips 219 (FIG. 28A) are attached to each of radially extending flanges 211 and include a bent outer flange 220 along its outer edge. The outer flanges 212 and 220 define four planar sides 221A–221D of a square around the post 203. Large sections are cut out of the flanges 210 and 211 to form apertures 222 (FIG. 28) to allow wiring and conduit 223 (FIG. 1) to be routed internally between the sides 221A–221D. Brackets 224 (FIGS. 28 and 28A) are attached between the radially extending flanges 211 of the C channels 209, such as in the apertures 222. The brackets 224 secure the radially extending flanges 211 relative to each other, so that the cross section of the post 203 is orthogonally rigid so that the slots 214 can still be used for supporting weighty furniture despite the large sections that are cut out of the C channels 209 to form the apertures 222. Utility supporting brackets 225 (FIG. 28B) are also provided for attachment to the C channels 209 to support electrical devices, such as utility outlets such as duplexes and communication outlets 225'. Post covers 226 (FIG. 39) include a body panel 226' and legs 227 for snap attachment onto the terminating flanges 213 (and/or onto outer flange 220 of strip 219) to aesthetically trim out the post 203. Resilient flaps 228 on the covers cover the slots 214, but permit selective access thereto.

Figure 32:
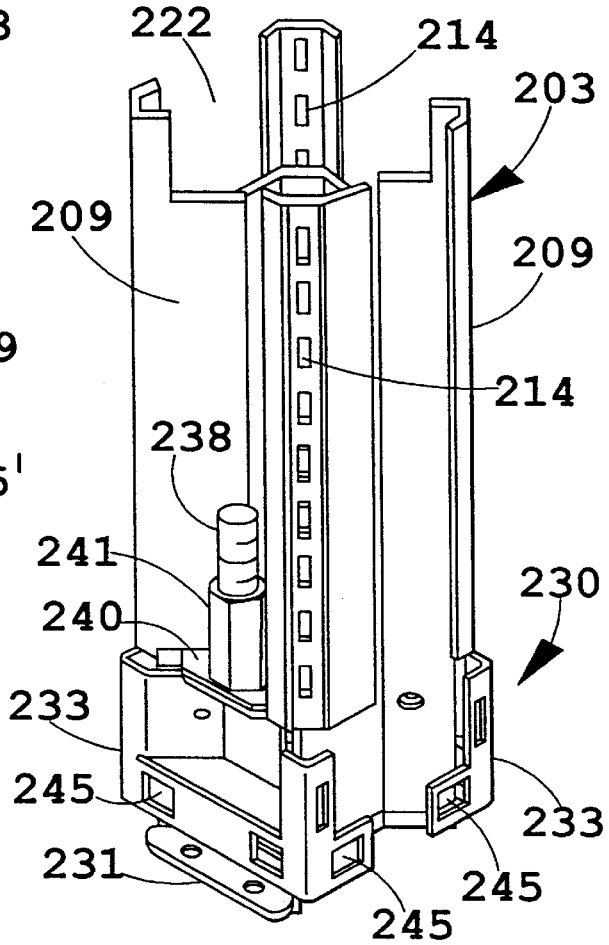
FIG. 32 is an enlarged perspective view of a bottom of the post shown in FIG. 28 and an adjustable bottom piece (or foot) attached to the post.
Figure 32A:
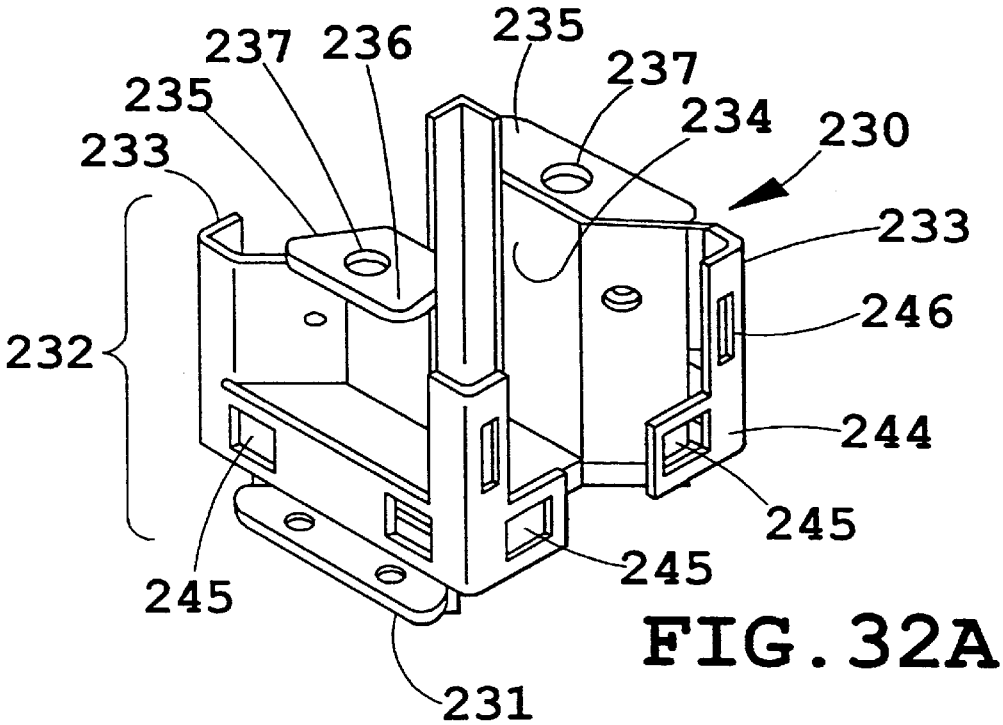
FIG. 32A is an enlarged perspective view of a majority of the bottom piece of the post shown in FIG. 32, but with the C-shaped side members removed for clarity.
Figure 32B:
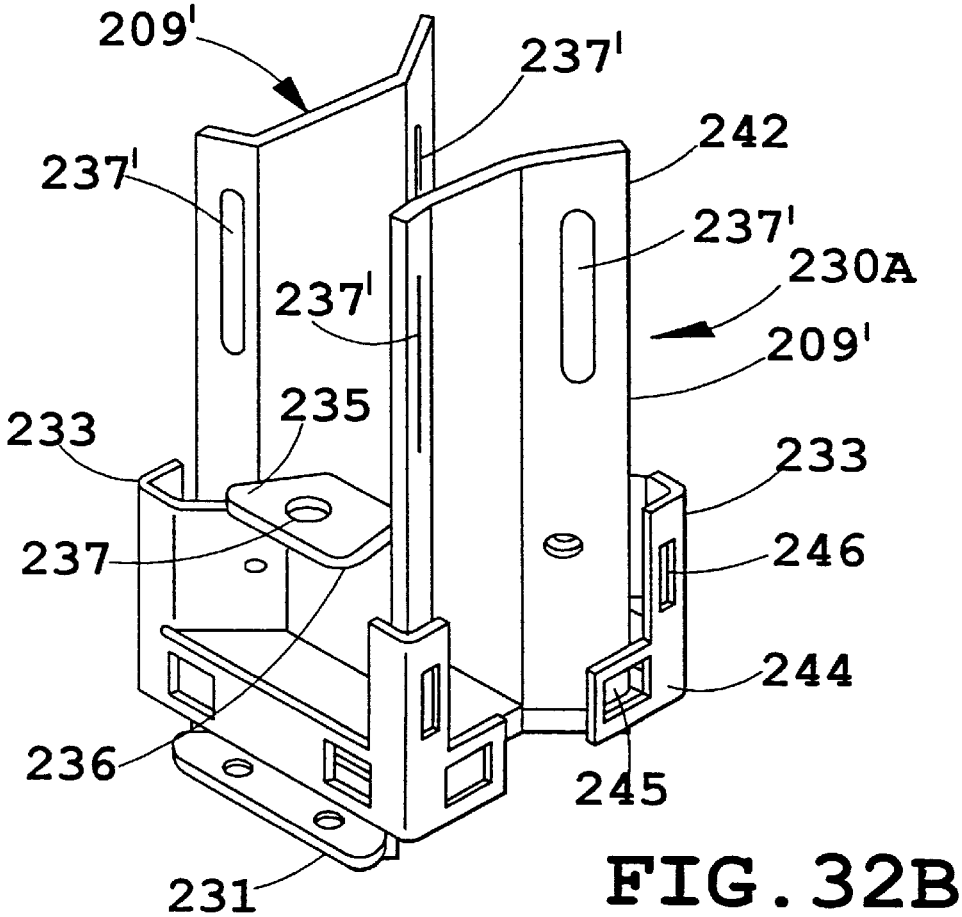
FIG. 32B is an enlarged perspective view of the bottom piece shown in FIG. 32A, but including the C-shaped side members.

A floor-engaging foot or bottom piece 230 (FIG. 32A) has a flat floor plate 231 adapted to stably engage a floor, and a vertically extending section 232. The section 232 includes opposing W-shaped channels 233 with inner wall sections 234 shaped to mateably engage opposing outer side surfaces of the C channels 209'. Parallel horizontal plates 235 and 236 are welded to an outside of wall sections 234, and include dimples 237 for receiving a lower end of the leveling screws 238. C channels 209' extend from floor plate 231 to about 12-inches high and are welded in place to rigidify the bottom piece 230. Slots 237' are provided in C channel 209' for permitting attachment by screws 237" of post 203 to the bottom piece 230, thus permitting the post 203 to be locked in an adjusted position after vertical adjustment of the post 203 on the bottom piece 230.

Figure 41:
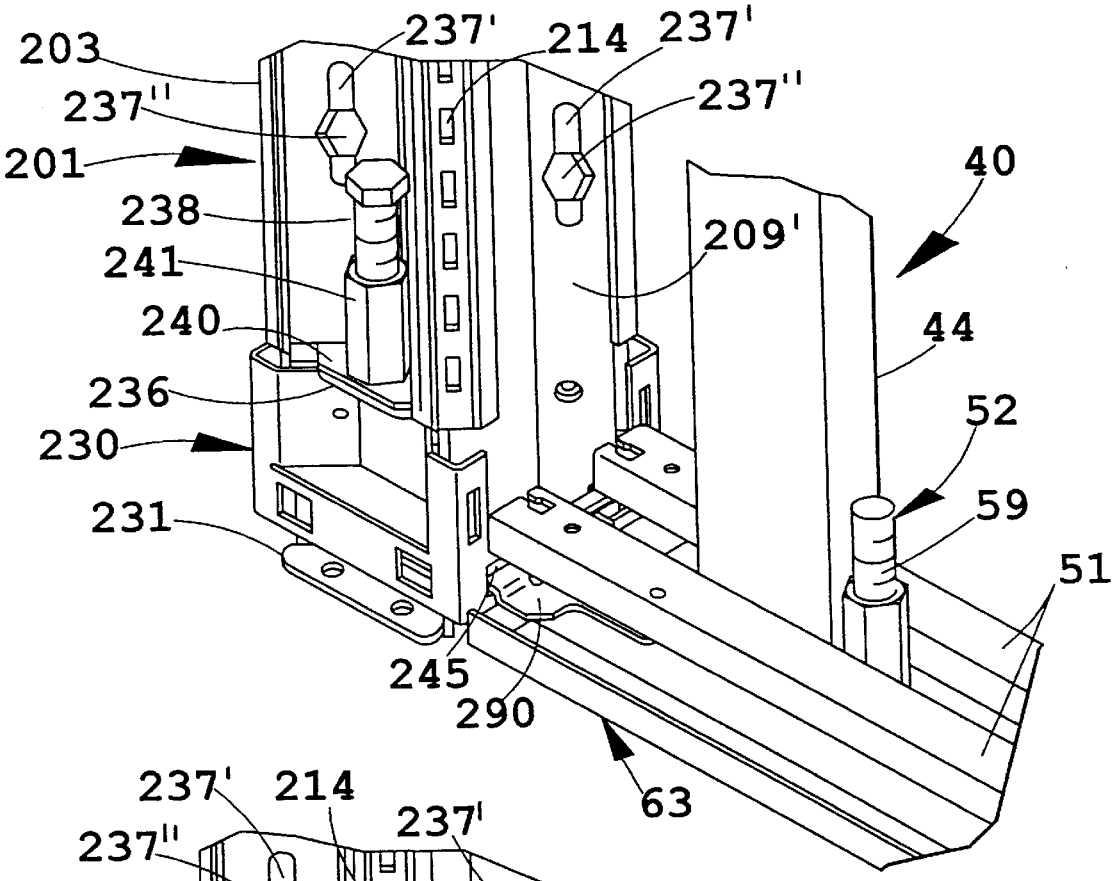
FIGS. 41 and 42 are perspective views of a bottom area of the post and the partition, FIG. 41 showing the post and partition in a lowered floor-adjacent position, and FIG. 42 showing the post and partition in a vertically adjusted raised position.
Figure 42:
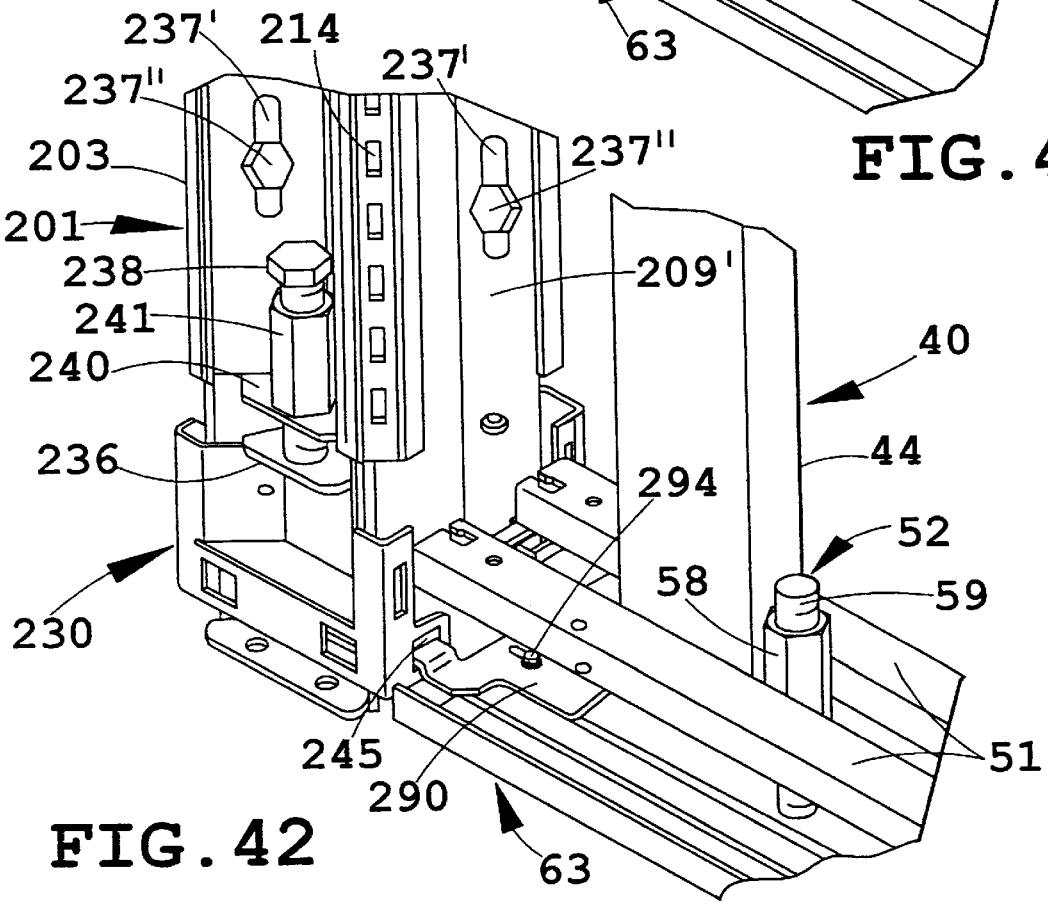

A pair of flat plates 240 (FIG. 32) are welded between the C channels 209 on post 203 at a bottom thereof. Flat plates 240 can have apertures 240' (FIG. 28B) for routing wiring through to a floor. A nut 241 (FIG. 32) is welded atop each of the plates 240 over a hole 241' (FIG. 28B) in the plates 240, and leveling screws 238 (FIG. 32) are threaded through each of the nuts 241. The leveling screws 238 extend downwardly into engagement with the dimples 237. By turning the leveling screws 238, a height of the posts 203 can be adjusted (compare FIGS. 41 and 42). Further, the pair of leveling screws 238 allow the post 203 to be stably supported even on uneven floor surfaces.

It is contemplated that the floor-engaging foot 230 for post 203 can take on very different forms.

Foot 230 includes corner flanges 244 defining floor-adjacent apertures 245 and corner-adjacent apertures 246. The corner-adjacent apertures 246 support a trim cover for covering sides of the foot 230. The floor-adjacent apertures 245 are designed to engage a bottom connector 290 for retaining the floor channel 63 to the floor-engaging foot 230, as discussed in greater detail below.

Figure 33:
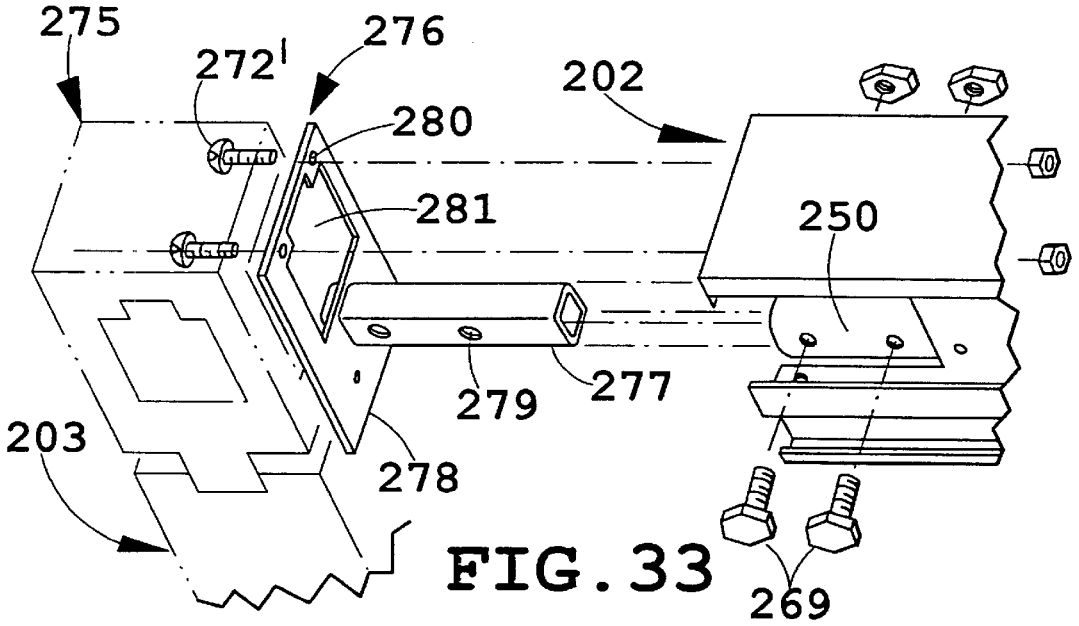
FIG. 33 is an exploded perspective view of an end of the beam (in solid lines) and box-like end connectors (in phantom lines) shown in FIG. 27A.
Figure 34:
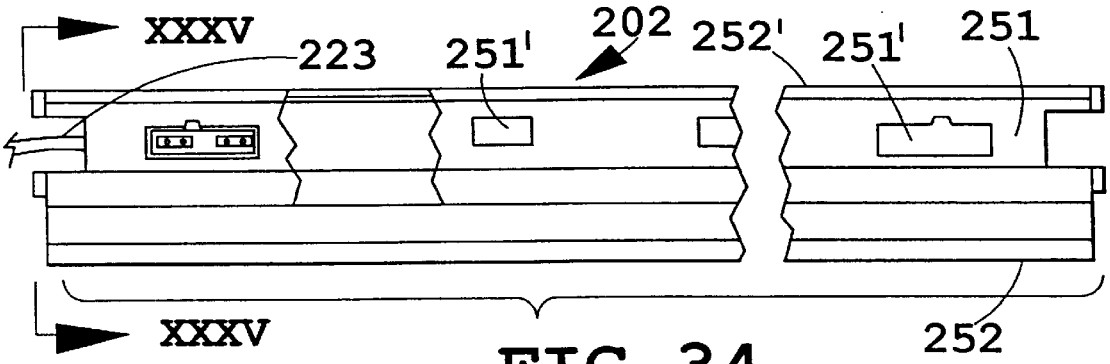
FIG. 34 is a fragmentary side view of the beam shown in FIG. 27A.
Figure 36:
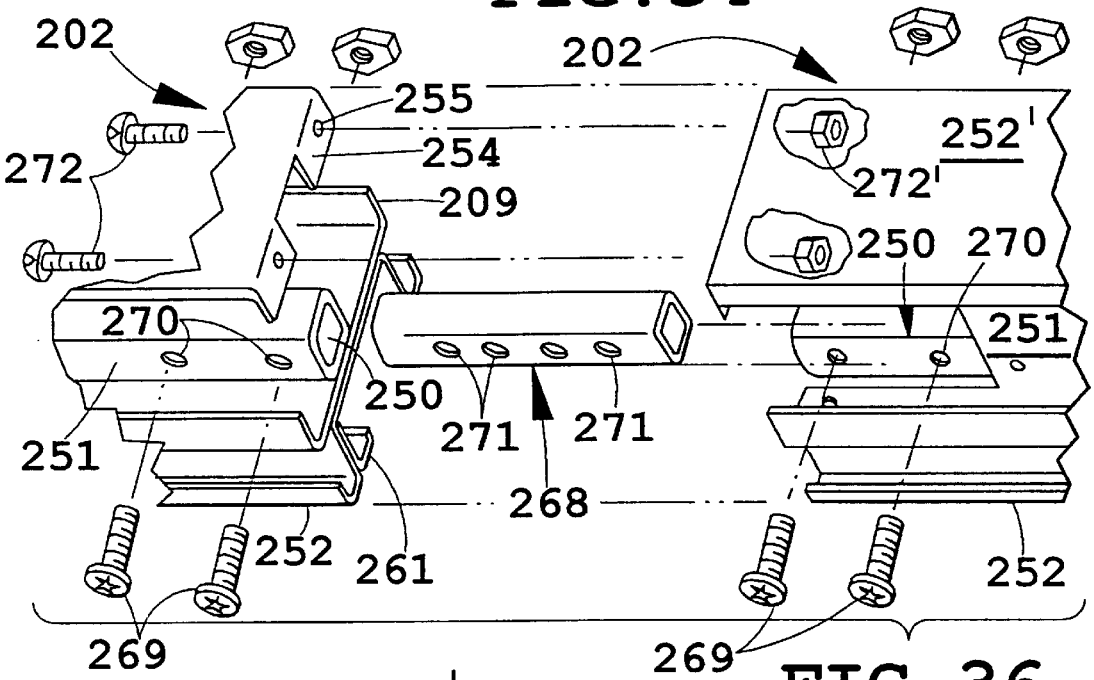
FIG. 36 is an exploded perspective view of a pair of the beams shown in FIG. 27A connected together with an in-line connector.
Figure 35:
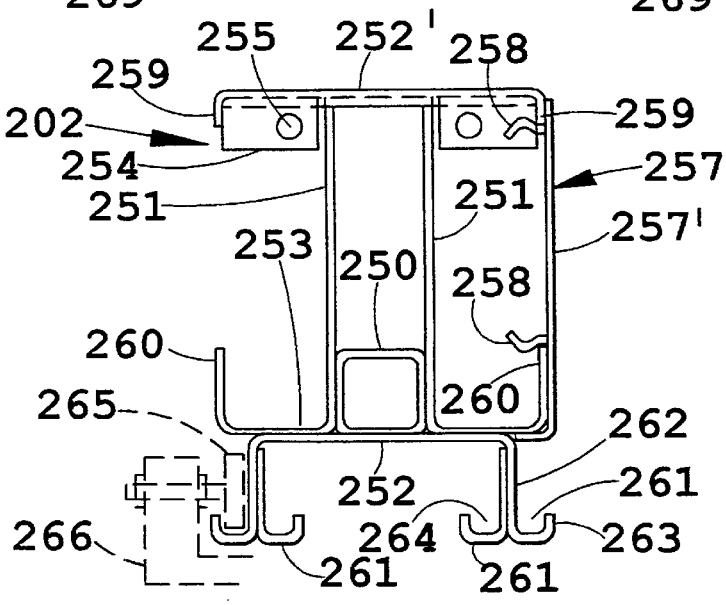
FIG. 35 is an end view of the beam shown in FIG. 34 including a roller-supported screen (shown in phantom)
Figure 37:
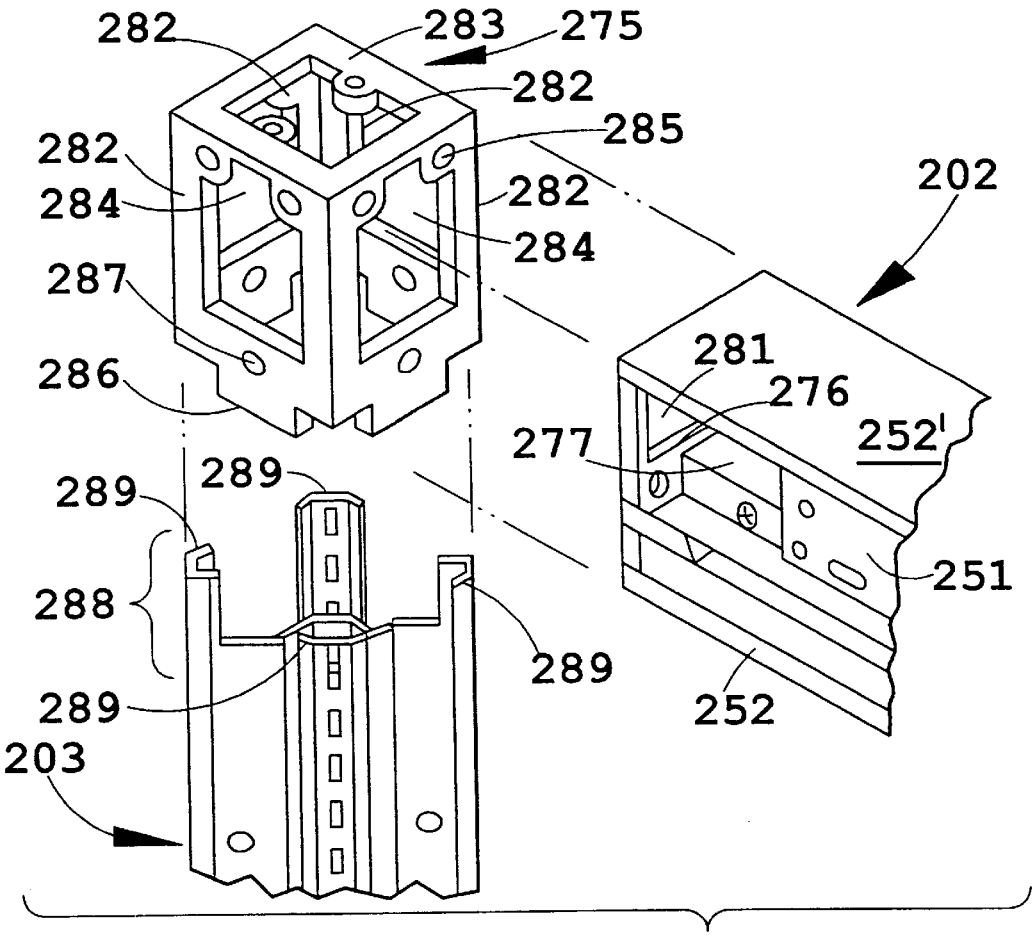
FIG. 37 is an enlarged exploded perspective view of the post, beam, and box-like end connector shown in FIG. 27A.
Figure 38:
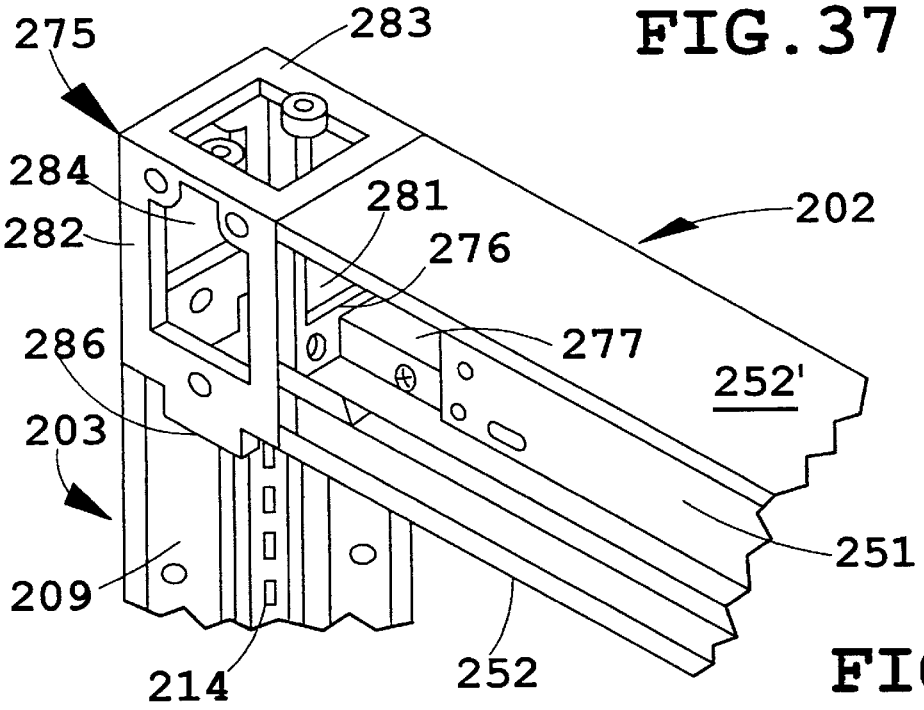
FIG. 38 is an enlarged perspective view of the assembly of the post, beam, and box-like end connector shown in FIG. 37.

The beam 202 (FIG. 35) includes a horizontal tube 250. Opposing outwardly facing C-shaped side channels 251 are welded on opposite sides of the tube 250. A downwardly facing C-shaped bottom channel 252 is welded to a bottom of the tube 250 and to bottom flanges 253 of the side channels 251, and a downwardly facing top channel 252' is welded to a top of the side channels 251. Apertures 251' in side channels 251 (FIG. 34) permit wiring to be routed between its sides. End flanges 254 (FIG. 36) are formed at the ends of the beam 202, and include holes 255 for attachment to an end connector 276 (FIG. 33) to a corner piece 275 (FIG. 37). Covers 257 (FIG. 35) include a body 257' and resilient legs 258 that extend from body 257' for snap attachment to edges 259 and 260 of the side channels 251. J-shaped channels 261 are attached to the down flanges 262 of the bottom channel 252. The down flanges 262 and the rolled-up edges 263 of the J-shaped channels 261 include edges defining upwardly facing grooves 264. The grooves 264 are configured to be engaged by rollers 265 that carry a furniture unit, such as a hanging markerboard 266.

Beams 202 (FIG. 36) are connectable in-line by extending a tubular connector 268 into tubes 250, and by securing the tubular connector 268 in place with screws 269 that extend through holes 270 and 271 in the respective tubes 250 and tubular connector 268. Screws 272 can also be extended through holes 255 in the end flanges 254 of the beams 202 into nuts 272' to attach the ends of aligned beams 202 directly together.

Beams 202 are also connectable in "T," "X," or in-line arrangements at posts 203 by use of a box-like post corner piece 275 (FIG. 37) and end connectors 276. End connector 276 (FIG. 33) includes a tube section 277 similar to tubular connector 268 and further includes an end plate 278. The tube section 277 is extendable into the tube 250 and includes a pair of holes 279 that align with the holes 270 for receiving securement screws 272. The end plate 278 also includes holes 280 that align with the end holes 255 on the end flanges 254 of beam 202. An enlarged aperture 281 permits routing of wiring and utilities from the beam 202 through the end connector 276 into the box-like post corner piece 275 and into the associated post 203.

The box-like post corner piece 275 (FIG. 37) includes four side plates 282 and a top plate 283. The side plates 282 and the top plate 283 are generally rectangular and include enlarged rectangular apertures 284 that generally align with the aperture 281 in the end connector 276. The side plates 282 further include holes 285 that align with the holes 279 on the end plate 278 for receiving securement screws 272. The side plates 282 each include a down tab 286 with holes 287 for securement to the post 203 as follows. The post 203 includes an upper end 288 (FIG. 37) configured to fit mateably into an open bottom of the post corner piece 275, with the tabs 286 extending downwardly into the space between the protruding corners 289 of the post 203, and with the ends of the protruding corners 289 abutted or positioned closely adjacent the top plate 283. The post 203 is secured to the post corner piece 275 by screws that extend through the holes 287, or by other bracketry (not specifically shown) adapted to rigidly and squarely interconnect the two components, but that permits routing of utilities therethrough. Several alternative constructions of the post-to-beam attachment structure are possible and contemplated, with the key criteria being rigidity and squareness of the assembly. It is contemplated that several different corner constructions are within the ability of a person of ordinary skill in this art.

Figure 39:
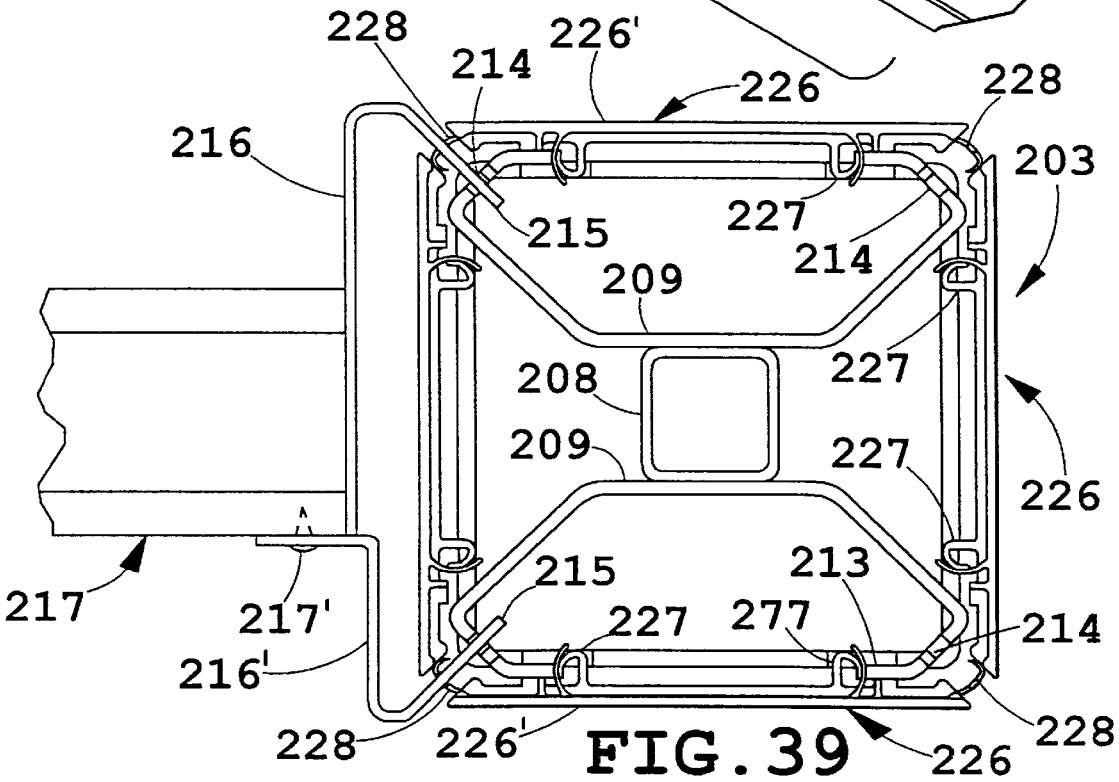
FIG. 39 is a cross-sectional view of a post including a furniture unit, such as a screen, releasably attached thereto.

FIG. 39 shows a cross section of the post 203 including covers 226. A furniture unit (i.e., screen 217) is attached to the post 203 by brackets 216 and 216'. The brackets 216 and 216' each include hooks 215 engaged with slots 214 in the post 203. Bracket 216' is a locking bracket, and is inserted into the slots 214 after the bracket 216 is in place. The bracket 216' is thereafter screw-attached to the screen 217 by a screw 217'. Other securement procedures are also possible, as will be apparent to a person skilled in the art.

Figure 40:
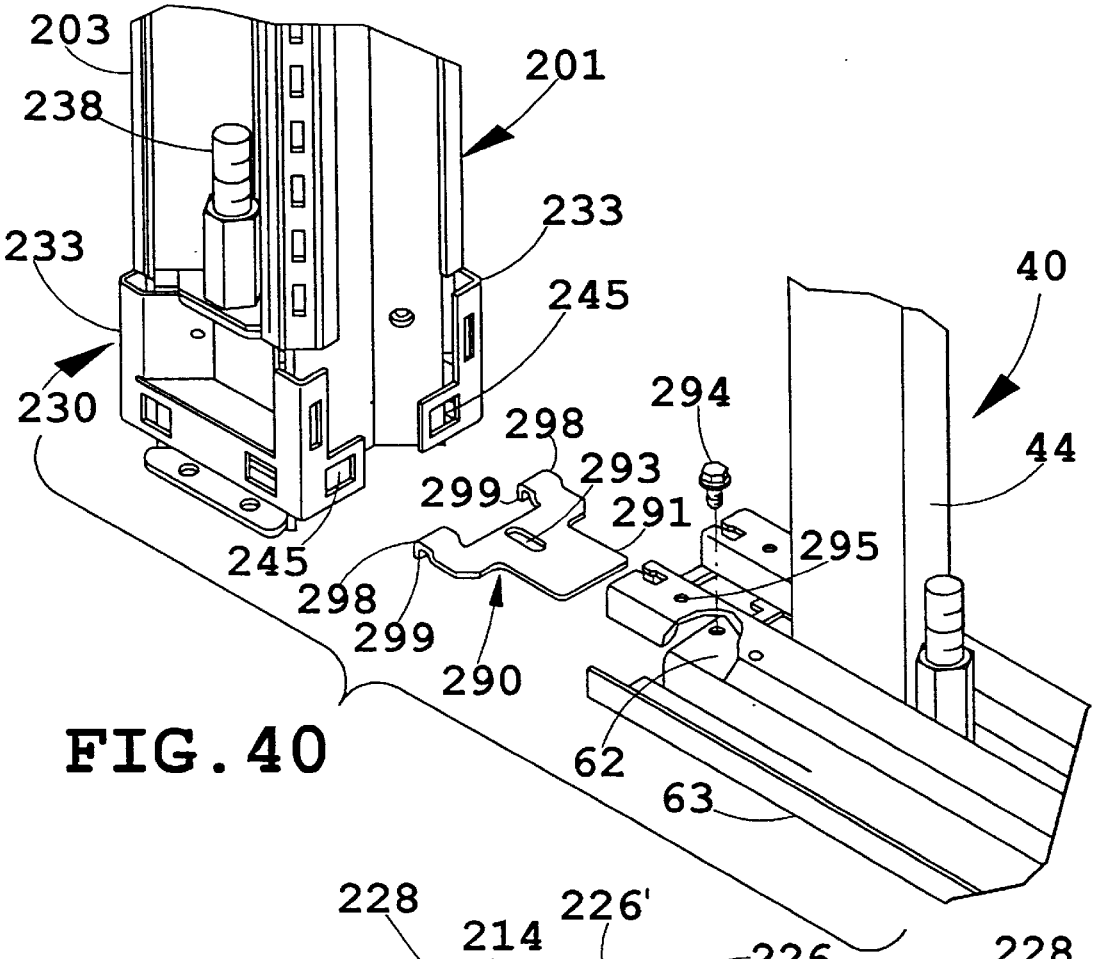
FIG. 40 is an exploded perspective view of a bottom section of the post and an end of the floor channel and partition, including a hook-attach connector for attaching and aligning these components.

The floor channel 63 of partition system 40 (FIG. 40) is attached to the foot 230 by a fork-shaped bottom connector 290. Bottom connector 290 includes a flat end portion 291 adapted to rest on a center flange of the hat-shaped section 62 of floor channel 63. An aperture 293 in the flat end portion 291 receives an attachment screw 294 that extends through the aperture 293 threadably into a hole 295 in the center flange 292. The threads of the hole 295 can be formed in extruded material forming the hole 295, or can be located on a weld nut spot welded onto the floor channel 63. The other end of the bottom connector 290 includes spaced-apart arms 298 having downwardly facing hooked ends 299. The hooked ends 299 are configured to mateably engage the apertures 245 to hold the floor channel 63 adjacent the foot 230, and to hold the floor channel 63 in alignment with the foot 230. The hooked ends 299 can be released by loosening the screw 294 and by liftingly removing the hooked ends 299 from the apertures 245. However, the hooked ends 299 and the apertures 245 are configured with relatively close clearances, so that the task of disconnecting them does not accidentally occur, particularly in view of the weight and horizontal orientation of the partition system 40. It is noted that the bottom connector 290 does not move during adjustment of the levelers on the partition system 40 and the overhead framework system 201 (compare FIGS. 41 and 42).

Figure 43:
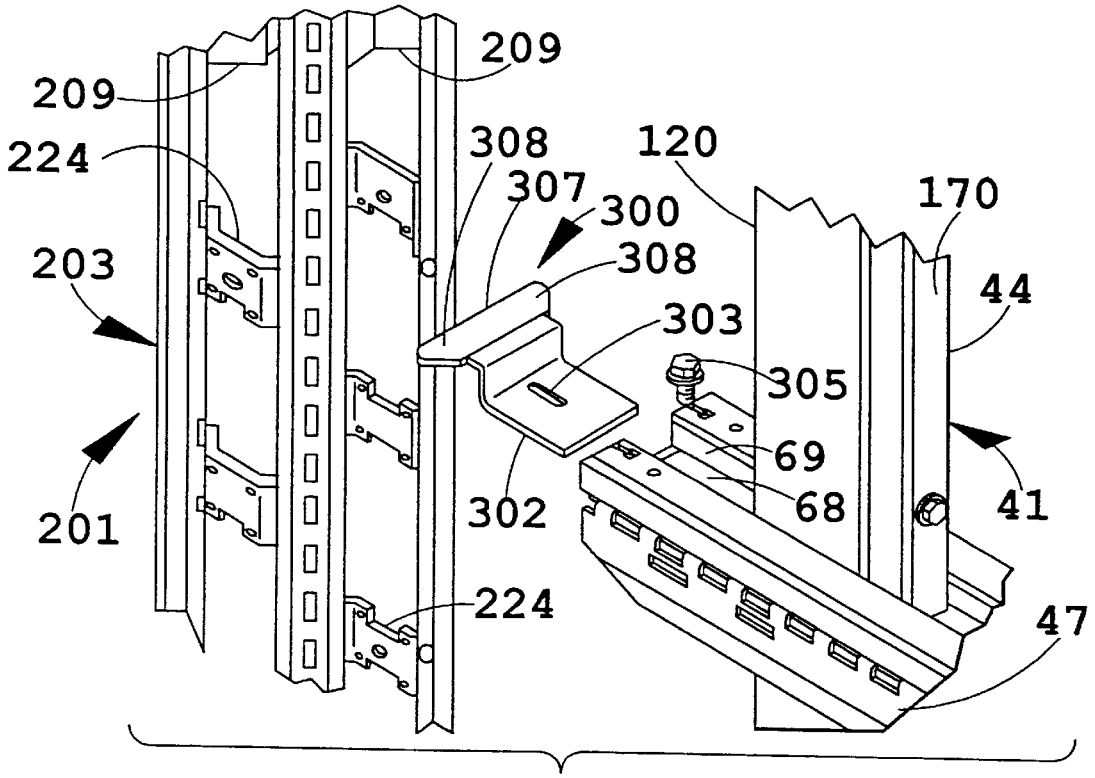
FIG. 43 is an exploded perspective view of a first intermediate slip connector that connects a vertical side edge of a partition to the side of a post.

Two slip-type intermediate connectors 300 and 301 (FIG. 46) stamped from sheet metal are used to connect the partitions 41 (and 43) to the posts 203. The first intermediate connector 300 (FIG. 43) includes a flat end portion 302 with an aperture 303 therein. The flat end portion 302 is configured to rest on the center flange 68 of frame 44 or other similar structure on the partition 41, with the aperture 303 being located for attachment to the partition 41 by a downwardly facing screw 305. In order to horizontally stabilize the intermediate connectors 300 (and 301) on the partitions, the flat end portion 302 fits snugly between flanges 69 on the sides of the center flange 68 of partition frame 41. Alternatively, the flat end portion 302 can include a down finger (not specifically shown, but see FIGS. 24 and 25) that extends into a second hole in the partition. The other end 307 (i.e., the post-engaging end) of the intermediate connector 300 extends horizontally generally parallel (but not coplanar with) the flat end portion 302. The other end 307 includes outwardly flared corners 308. These outwardly flared corners 308 include angled surfaces that are shaped to mateably but slidingly engage opposing sides of the post 203 (FIGS. 28A and 44) in a manner that retains the partition 41 closely adjacent the post 203, but in a manner that allows the intermediate connector to vertically slide longitudinally along the post 203. This allows the leveler of the post 203 to be vertically adjusted and/or the leveler of the partition to be vertically adjusted independently from the other system.

Figure 28A:
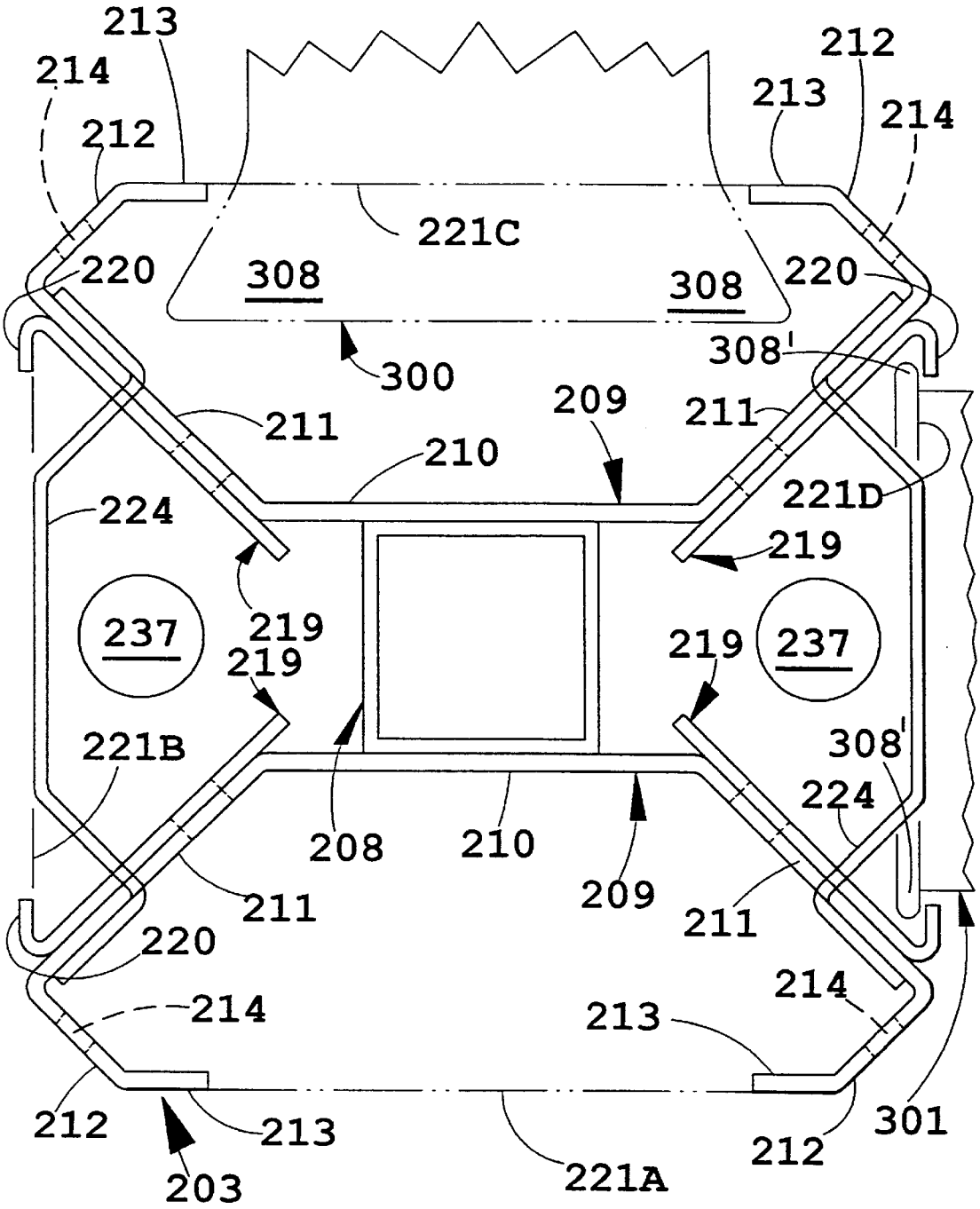
FIG. 28A is a cross-sectional view taken along the line XXVIIIA—XXVIIIA in FIG. 28 including the slip connectors of FIGS. 43 and 45.
Figure 28B:
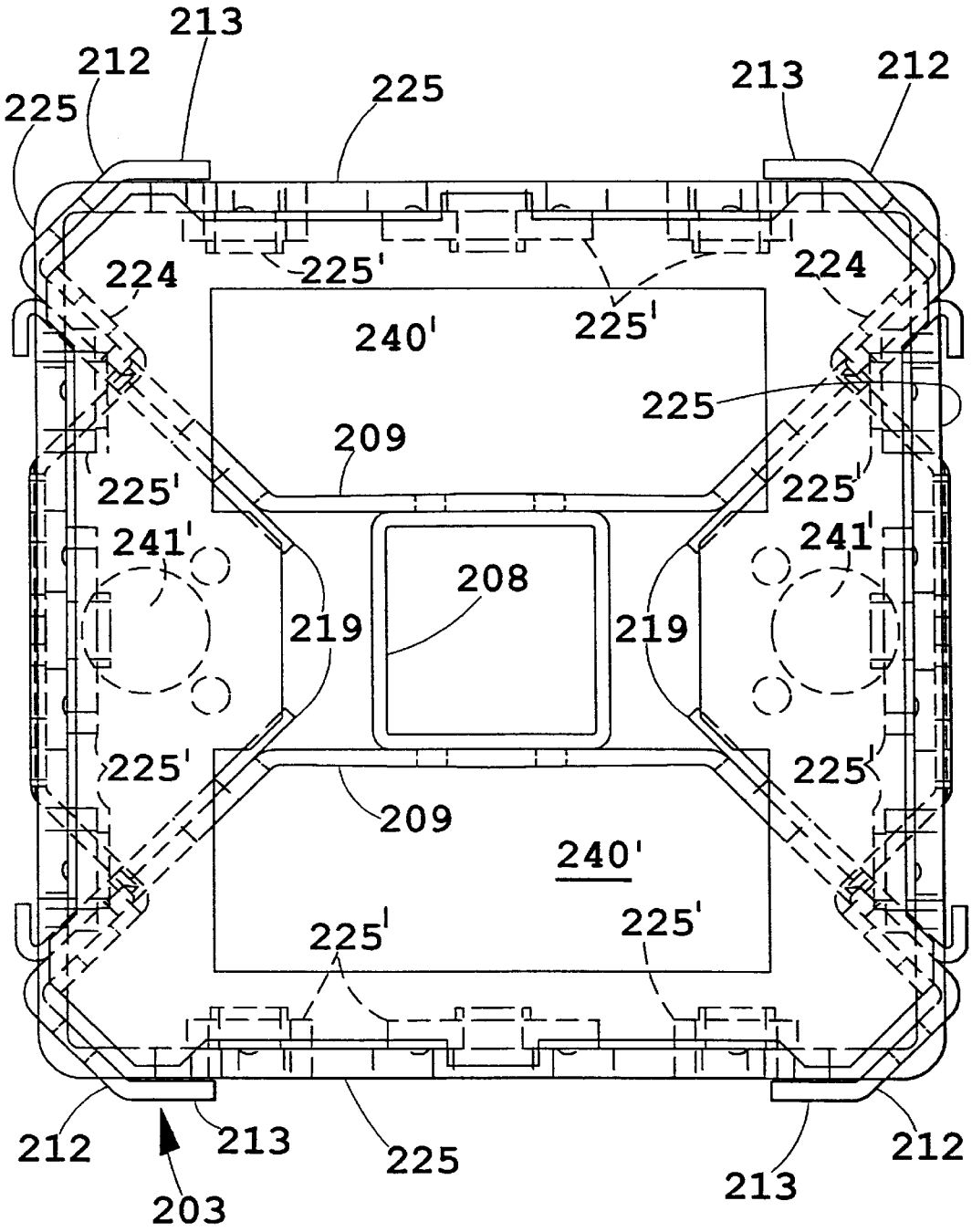
FIG. 28B is a cross-sectional view similar to FIG. 28A but including outlet support brackets and a bottom piece attached to the post frame.
Figure 31:
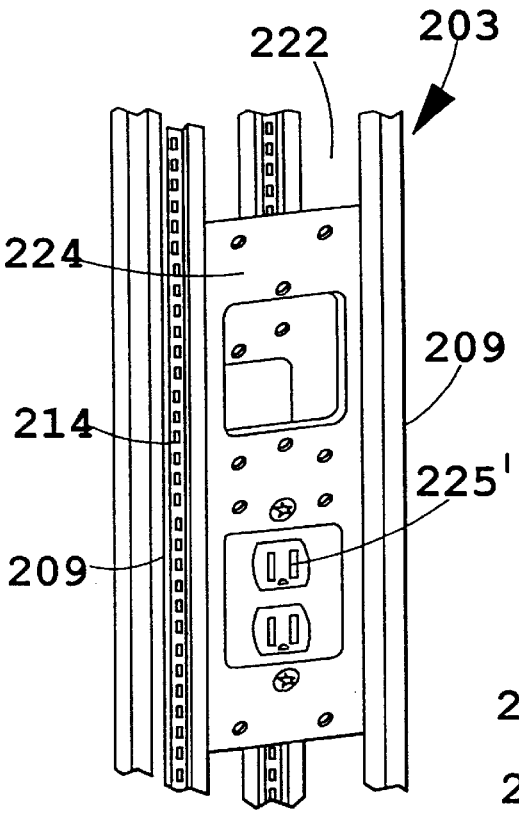
FIG. 31 is an enlarged perspective view of a center section of the post shown in FIG. 28, including utility support brackets.
Figure 45:
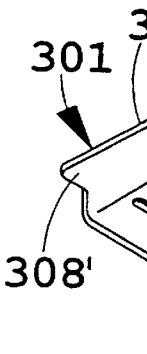
FIG. 45 is a perspective view of a modified second intermediate slip connector for interconnecting the vertical side edge of a partition to the side of a post.
Figure 46:
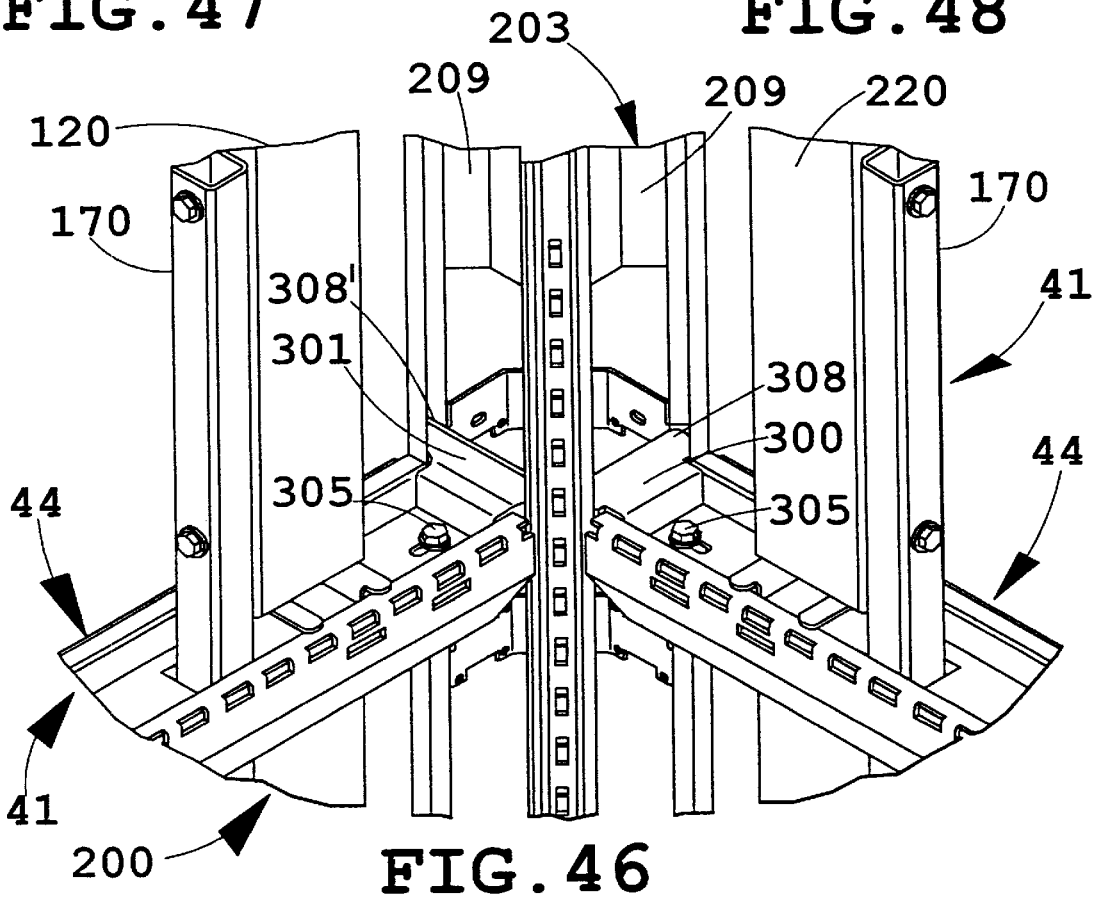
FIG. 46 is a perspective view showing use of both the first and second intermediate connectors of FIGS. 43 and 45.

The second intermediate connector 301 (FIG. 45) includes a flat end portion 302' that is identical to flat end portion 302 and that is connectable to the partition 41 or 43 in the same manner. The post-engaging end 307' of intermediate connector 301 is similar to the other end 307 of the first intermediate connector 300, but the other end 307' is bent upwardly substantially vertically. This allows the outwardly flared corners 308' to engage flanges on the post 203 without protruding inwardly so far as to interferingly engage the other structure in the post 203. Intermediate connector 301 also is vertically movable and adjustable longitudinally along the post 203 (FIGS. 28A and 46).

Figure 26:
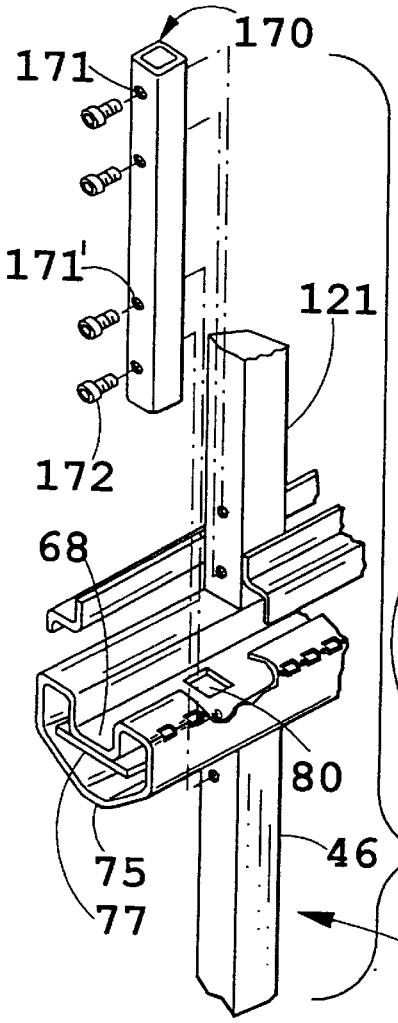
FIG. 26 is a fragmentary perspective view showing attachment of a stacker frame to a floor-engaging base frame, and showing a tubular connector that bolts to the base frame and extends upwardly to the stacker frame.
Figure 47:
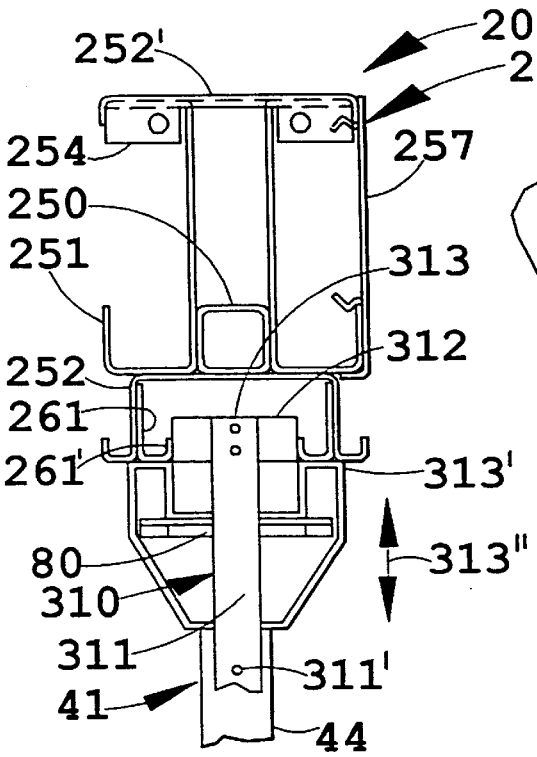
FIG. 47 is an end view of a top of the partition as connected to a bottom of a beam, including the top connector for connecting same, the top connector providing a slip-attach connection to the beam.
Figure 48:
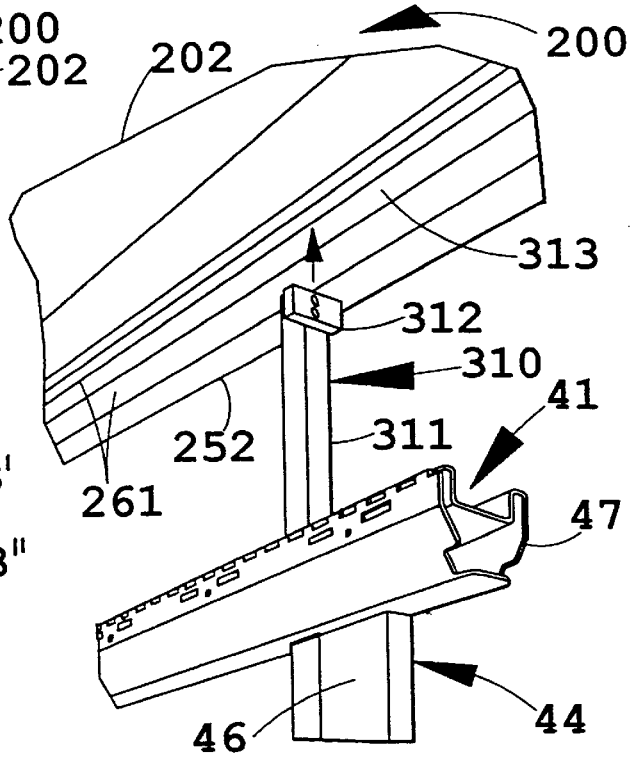
FIG. 48 is an exploded fragmentary perspective view of the partition, the beam, and the top connector of FIG. 47.

A vertically extending slip-type top connector 310 (FIG. 47) includes a tube section 311 similar to stacker bracket 170 (FIG. 26). Top connector 310 (FIG. 47) is constructed to fit through the aperture 80 in a partition frame 41 and is constructed to be bolted to the partition frame 44 by screws 311'. A flat rectangular plate 312 is welded transversely to a top of the tube section 311. The flat rectangular plate 312 has a width and overall dimensions chosen so that the plate 312 slip fits transversely into a bottom of the beam 202 in a space 313 between the inner up flanges 261' of the J-shaped channels 261 on the beam 202. The flat rectangular plate 312 permits vertical adjustment, as shown by arrow 313". Nonetheless, it is noted that, after the top connector 310 is positioned in the space 313 and is attached to the partition frame 44, the partition frame 44 will normally be adjusted vertically against a bottom of the J-shaped channels 261, so that there is no objectionable gap 313' between the partition system 40 and the overhead framework system 201. Notably, the top connector 310 can be oriented so that the partition 40 can be located entirely under a particular beam 202, or can be oriented at 90° so that the partition 41 only has an end portion under the beam 202 (with the rest of the partition 41 extending laterally and outwardly from under the beam 202). In this later arrangement, the top connector 310 must frictionally engage the partition 41 sufficiently to stabilize the partition 41, even though only a single top connector 310 is used. Potentially, the top plate is configured for screw attachment to the beam 202. When partition 41 is positioned entirely under the beam 202, a pair of top connectors 310 can be used and no screw attachment is required.

Figure 1A:
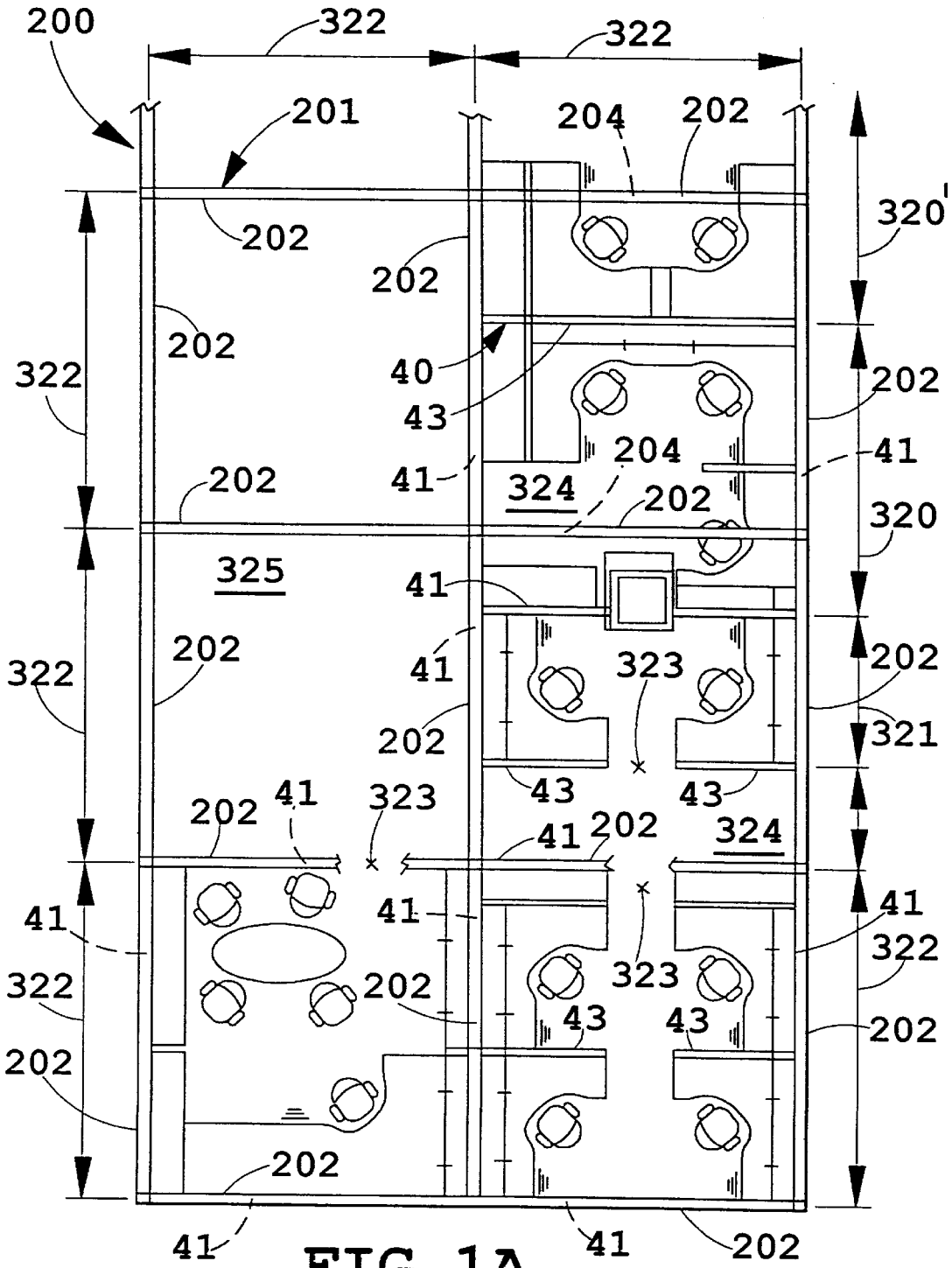
FIG. 1A is a top view of an office arrangement utilizing the framework system and partition system of FIG. 1.
Figure 1B:
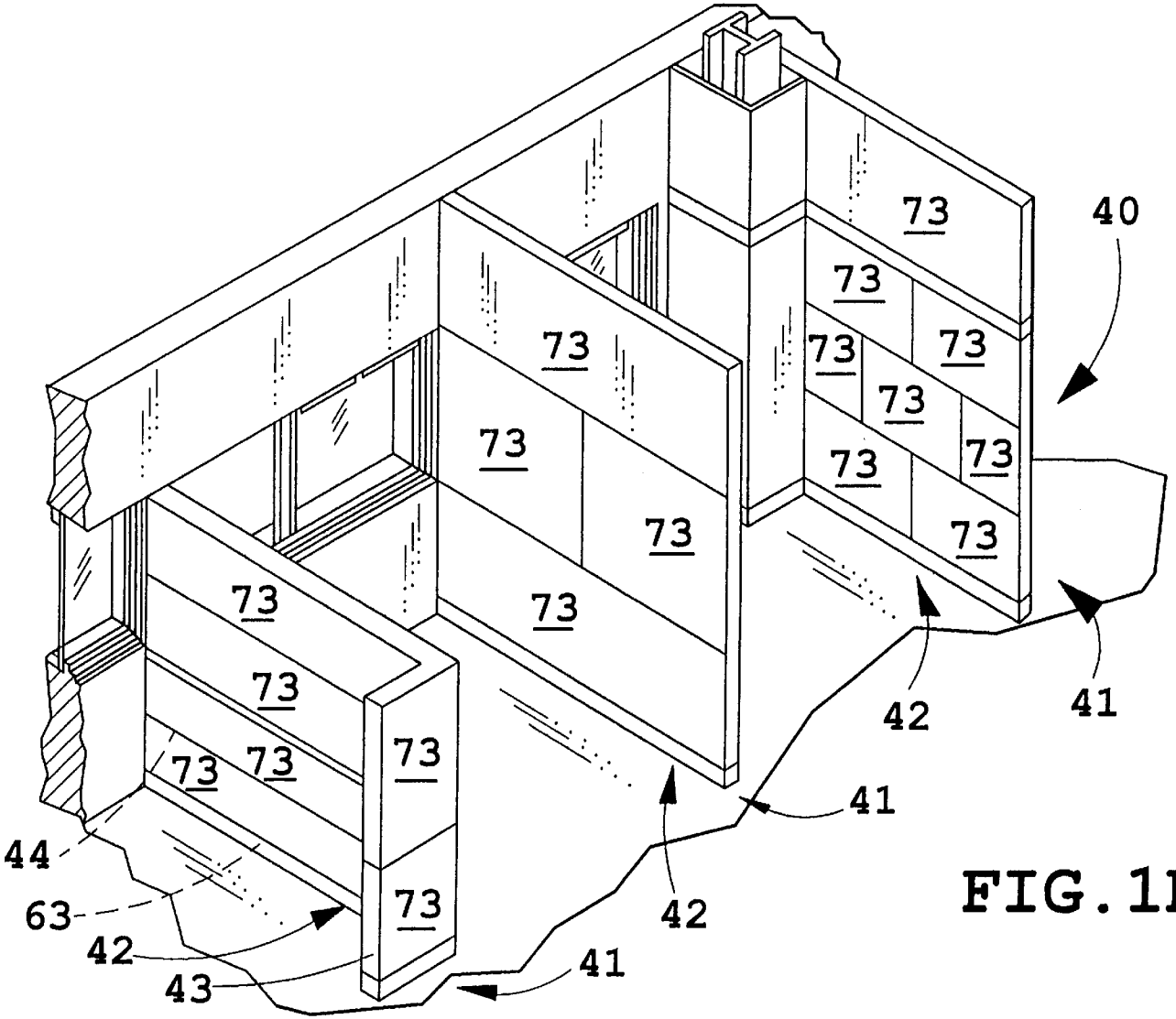
FIG. 1B is a perspective view of the partition system of FIG. 1 installed as a separate stand-alone system in a building space.

FIG. 1 illustrates the fact that "fin" partitions 43 can be used to stabilize a "spine" partition 41, or the spine partition 41 can be attached directly to a post 203 to stabilize the post 203 (see the lower right corner of FIG. 1 where top connector 310 is used). FIG. 1 also illustrates that the partition system 40 can be used to completely fill a space under a beam 202 (see the left side of FIG. 1), or can be used to partially vertically fill the space under a beam 202 with a top space 319 being left open (see a center of FIG. 1), or can be used to partially horizontally fill the space under a beam 202 with a side space 318 being left open (see a right side of FIG. 1). FIG. 1A further illustrates that the partition system 40 can be located around the posts 203 of the overhead framework system 201, with only limited concern for locating the overhead framework system 201 relative to the offices formed by the partition system 40. For example, the illustrated offices have dimensions of 320, 320', 321, and 322, while the posts 203 are located uniformly at distances of dimension 322. Also, the office arrangement includes doorways 323, aisles 324, and a common area 325 integrated into the office arrangement, many of which are not related to the overhead framework 201 other than by chance. It is contemplated that the illustrated office arrangement of FIG. 1A will be used where a customer desires the utility-distributing function of the posts 203 and beams 202, along with the appearance, but where the partition system 40 still will be used to achieve rearrangeability of the offices and to provide functional structures for the offices. Wiring and conduit 223 (FIG. 1) can be routed in and around the wireways defined inside of the posts 203 and beams 202, and into the wireway defining interior of the partition system 40 to power outlets 327 at workstations (FIG. 1A).

In the foregoing description, it will be readily appreciated by those skilled in the art that modifications may be made to the invention without departing from the concepts disclosed herein. Such modifications are to be considered as included in the following claims, unless these claims by their language expressly state otherwise.

What is claimed is:

1. An integrated furniture system for subdividing a building space having a floor surface, comprising:

an overhead framework system including a beam and a pair of floor-engagable posts supporting the beam overhead, the beam and floor engagable posts being interconnected and having planar inner marginal surfaces defining a bounded space below the beam and between the floor-engagable posts; and a partition system including a partition having top and bottom side edges and vertical side edges defining dimensions shaped to fit into the bounded space, with the partition being located completely within the bounded space and attached to the framework, but also including floor-engagable supports for supporting the partition on the floor surface separate from the overhead framework system;

wherein the floor-engagable supports include first levelers that are adjustable for vertically adjusting the partition relative to the framework system, and the posts include second levelers that are adjustable for vertically adjusting the overhead framework system relative to the partition.

2. An integrated furniture system for subdividing a building space, comprising:

an overhead framework system constructed to be used as a stand-alone system to provide a relatively open meeting area in the building space, the overhead framework system including at least one horizontally extending beam and posts supporting the beam overhead, the beam and posts having inner marginal surfaces defining a bounded space below the beam and between the posts, the bounded space having a first height dimension and a first width dimension;

a furniture-supporting partition system constructed to be used as a stand-alone system to subdivide a building space into an arrangement of physically separated offices, the furniture-supporting partition system including at least one partition having vertical side surfaces defining a second width dimension and horizontal side edges defining a second height dimension;

the at least one partition including at least a portion being positioned in the bounded space under the beam and being connected to the overhead framework system; and wherein the partition includes a partition frame and covers engaging the partition frame, the partition frame including uprights and horizontal beams that define horizontal and vertical raceways in the partition frame that extend to each of the side edges.

3. The integrated furniture system defined in claim 2 wherein the beam defines an overhead wireway, and the partition frame defines a second wireway configured to directly communicate with the overhead wireway.

4. An integrated furniture system for subdividing a building space, comprising:

an overhead framework system constructed to be used as a stand-alone system to provide a relatively open meeting area in the building space, the overhead framework system including at least one horizontally extending beam and posts supporting the beam overhead, the beam and posts having inner marginal surfaces defining a bounded space below the beam and between the posts, the bounded space having a first height dimension and a first width dimension;

a furniture-supporting partition system constructed to be used as a stand-alone system to subdivide a building space into an arrangement of physically separated offices, the furniture-supporting partition system including at least one partition having vertical side surfaces defining a second width dimension and horizontal side edges defining a second height dimension; and the at least one partition including at least a portion being positioned in the bounded space under the beam and being connected to the overhead framework system;

wherein the partition includes a partition frame and covers engaging the partition frame, the partition frame including uprights and horizontal beams that define horizontal and vertical raceways in the partition frame that extend to each of the side edges; and wherein the uprights are connected to the horizontal beams at a distance from an end of the uprights.

5. An integrated furniture system for subdividing a building space, comprising:

an overhead framework including a beam and a pair of posts supporting the beam overhead, the beam and posts being interconnected and having inner marginal surfaces defining a bounded space below the beam and between the posts;

a partition including top and bottom surfaces and vertical side edges defining dimensions shaped to fit into the bounded space, the partition including at least one first leveler for adjustably leveling the partition on a floor surface; and a slip-fit connector connecting the partition to the overhead framework and configured to permit adjustment of the partition relative to the floor surface without also having to adjust a height of the overhead framework.

6. The integrated furniture system defined in claim 5 wherein the posts include at least one second leveler separate from the at least one first leveler for adjustably engaging a floor.

7. The integrated furniture system defined in claim 5 wherein the slip-fit connector extends laterally and engages one of the posts of the overhead framework and a vertical side edge of the partition.

8. The integrated furniture system defined in claim 7 including a second slip-fit connector that extends vertically and engages the beam and a top of the partition.

9. The integrated furniture system defined in claim 5 wherein at least the beam and the partition define raceways that are constructed to carry utilities and to communicate the utilities therebetween.

10. The integrated furniture system defined in claim 9 wherein the bounded space defines a first width dimension and first height dimension, and the vertical side edges and top and bottom surfaces of the partition define a second width dimension and second height dimension, and wherein one of the first width and height dimensions is greater than an associated one of the second width and height dimensions such that a large gap exists therebetween.

11. An integrated furniture system for subdividing a building space, comprising:

an overhead framework system constructed to be used as a stand-alone system to provide a relatively open meeting area in the building space, the overhead framework system including at least one horizontally extending beam and posts supporting the beam overhead, the beam and posts having inner marginal surfaces defining a bounded space below the beam and between the posts, the bounded space having a first height dimension and a first width dimension;

a furniture-supporting partition system constructed to be used as a stand-alone system to subdivide a building space into an arrangement of physically separated offices, the furniture-supporting partition system including at least one partition having vertical side surfaces defining a second width dimension and horizontal side edges defining a second height dimension; and the at least one partition including at least a portion being positioned in the bounded space under the beam and being connected to the overhead framework system;

wherein the partition is connected to the overhead framework system by a slip-fit connection that includes a vertical elongated connector that extends into the partition.

12. The integrated furniture system defined by claim 11, wherein the partition includes a frame with elongated uprights, and wherein the vertical elongated connector extends into the frame and connects to the uprights.

13. An integrated furniture system for subdividing a building space, comprising:

an overhead framework system constructed to be used as a stand-alone system to provide a relatively open meeting area in the building space, the overhead framework system including at least one horizontally extending beam and posts supporting the beam overhead, the beam and posts having inner marginal surfaces defining a bounded space below the beam and between the posts, the bounded space having a first height dimension and a first width dimension;

a furniture-supporting partition system constructed to be used as a stand-alone system to subdivide a building space into an arrangement of physically separated offices, the furniture-supporting partition system including at least one partition having vertical side surfaces defining a second width dimension and horizontal side edges defining a second height dimension; and the at least one partition including at least a portion being positioned in the bounded space under the beam and being connected to the overhead framework system;

wherein the partition includes a leveler and is vertically adjustable, and further is connected to the overhead framework system by a slip-fit connection;

wherein the slip-fit connection connects a side of the partition to the overhead framework system; and wherein the partition includes a frame and covers covering the frame, the frame including elongated uprights, and wherein the slip-fit connection includes a vertical elongated connector that extends into the frame and connects to one of the uprights.

14. The integrated furniture system defined in claim 13 wherein the partition lies completely within the space.

15. The integrated furniture system defined in claim 13 including a second slip-fit connection that connects a vertical side edge of the partition to one of the posts.

16. The integrated furniture system defined in claim 15 wherein one of the posts includes an X-shaped frame.

17. The integrated furniture system defined in claim 13 wherein the partition includes a partition frame and covers engaging the partition frame, the partition frame including uprights and horizontal beams that define horizontal and vertical raceways in the partition frame that extend to each of the side edges.

18. The integrated furniture system defined in claim 17 wherein at least one of the posts and the beam define an overhead wireway, and the partition includes a partition frame defining a second wireway configured to communicate with the overhead wireway.

19. The integrated furniture system defined in claim 13 wherein at least one of the second height and width dimensions are less than the first height and width dimensions.

20. The integrated furniture system defined in claim 19 wherein the second width dimension is less than the first width dimension.

21. The integrated furniture system defined in claim 19 wherein the second height dimension is less that the first height dimension.

22. The integrated furniture system defined in claim 21 wherein the second width dimension is less than the first width dimension.

* * * * *

UNITED STATES PATENT AND TRADEMARK OFFICE

CERTIFICATE OF CORRECTION

PATENT NO. : 6,112,472
DATED : September 5, 2000
INVENTOR(S) : Daniel Van Dyk et al.

It is certified that error appears in the above-identified patent and that said Letters Patent is hereby corrected as shown below:

[75] Inventors:

"Michael Miles" should be Michael E. Miles

Col. 7, line 2;

"modem" should be - - modern - -.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*